US010344462B2

(12) United States Patent
Soller et al.

(10) Patent No.: US 10,344,462 B2
(45) Date of Patent: Jul. 9, 2019

(54) TOILET RIMBLOCK AND METHOD OF MAKING SUCH RIMBLOCK

(71) Applicant: S. C. Johnson & Son, Inc., Racine, WI (US)

(72) Inventors: Douglas A. Soller, Racine, WI (US); Katherine Therese Rodriguez, Middle Village, NY (US); Steven A. Zach, Waterford, WI (US); Brandon C. Loss, Franksville, WI (US); Marina J. Maller, Thiensville, WI (US); Christina L. Gola, Sturtevant, WI (US); Cathal L. Fahy, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 15/507,508

(22) PCT Filed: Sep. 8, 2015

(86) PCT No.: PCT/US2015/048976

§ 371 (c)(1),
(2) Date: Feb. 28, 2017

(87) PCT Pub. No.: WO2016/040341

PCT Pub. Date: Mar. 17, 2016

(65) Prior Publication Data

US 2017/0247869 A1 Aug. 31, 2017

Related U.S. Application Data

(60) Provisional application No. 62/140,120, filed on Mar. 30, 2015, provisional application No. 62/092,694,
(Continued)

(51) Int. Cl.
*E03D 9/02* (2006.01)
*E03D 9/03* (2006.01)
*C11D 17/00* (2006.01)

(52) U.S. Cl.
CPC ..... *E03D 9/032* (2013.01); *C11D 17/0056* (2013.01); *E03D 2009/026* (2013.01)

(58) Field of Classification Search
CPC ..... E03D 9/032; C11D 17/0056
(Continued)

(56) References Cited

U.S. PATENT DOCUMENTS 1,502,634 A 7/1924 Ingebritson
1,974,955 A 9/1934 Foltis
(Continued)

FOREIGN PATENT DOCUMENTS

AU 2014277247 B2 7/2017
CN 1995216318 7/1995
(Continued)

OTHER PUBLICATIONS

Pictures of S.C. Johnson & Son, Inc. Toilet Rim Block Holder, published date unknown, but prior to the filing date of the present application.

(Continued)

*Primary Examiner* — Tuan N Nguyen

(57) ABSTRACT

A dispenser system for treating a toilet, the dispenser system comprising: a tray (402) having a rim at least partially surrounding a plurality of compartments (404) housing a treatment composition, each compartment (404) having a first side configured to be closed to flushing water and a second side configured to be open to flushing water, the second side defining an aperture for receiving the treatment composition; and a hanger (406) configured to suspend the tray (402) from a toilet bowl rim; and a cover coupled to the
(Continued)

rim for sealing the aperture of each compartment and configured to be removed by a user prior to use.

25 Claims, 22 Drawing Sheets

Related U.S. Application Data filed on Dec. 16, 2014, provisional application No. 62/047,312, filed on Sep. 8, 2014.

(58) Field of Classification Search
USPC ..... 4/231
See application file for complete search history.

(56) References Cited

U.S. PATENT DOCUMENTS 3,472,242 A 10/1969 Demner
3,604,020 A 9/1971 Moisa
4,203,172 A 5/1980 Goncalves
4,395,932 A 8/1983 Mills
D281,867 S 12/1985 Swesey et al.
D366,524 S 1/1996 Chung
D368,519 S 4/1996 Harrison et al.
5,729,835 A 3/1998 Williams
6,311,340 B1 11/2001 Thompson
D456,888 S 5/2002 Buthier
D461,006 S 7/2002 Buthier
D463,547 S 9/2002 Mascuilli
D464,107 S 10/2002 Holmes et al.
6,505,356 B1 1/2003 Leonard et al.
6,519,783 B2 2/2003 Falchieri
D478,973 S 8/2003 Wagner
D482,412 S 11/2003 Manville
6,647,558 B2 11/2003 Falchieri
6,651,261 B1 11/2003 Leonard et al.
6,675,396 B2 1/2004 Varanasi et al.
D498,841 S 11/2004 Bell et al.
6,817,040 B2 11/2004 Klinkhammer et al.
D507,051 S 7/2005 Bell et al.
D507,628 S 7/2005 McLellan et al.
6,934,973 B2 8/2005 Lehmann et al.
D509,891 S 9/2005 Rymer
D514,679 S 2/2006 Wheatley
7,028,917 B2 4/2006 Buthier
7,137,570 B2 11/2006 Wheatley et al.
D536,059 S 1/2007 King et al.
D537,914 S 3/2007 King et al.
D540,454 S 4/2007 Ruiz Ballesteros et al.
D541,902 S 5/2007 Cheung et al.
D554,309 S 10/2007 Wolk et al.
D555,757 S 11/2007 Cheung et al.
D556,946 S 12/2007 Seum et al.
D564,650 S 3/2008 Hasik et al.
D568,960 S 5/2008 Cheung et al.
D574,922 S 8/2008 Cheung et al.
D583,902 S 12/2008 Cheung et al.
D594,953 S 6/2009 King et al.
D596,738 S 7/2009 Chen et al.
D613,368 S 4/2010 Padain et al.
D616,974 S 6/2010 Hakim
D623,371 S 9/2010 Li
7,788,740 B2 9/2010 De Belder et al.
7,971,284 B2 7/2011 Pessel et al.
D642,668 S 8/2011 Lablaine
8,051,503 B2 11/2011 Nguyen et al.
D654,532 S 2/2012 Morales
D655,778 S 3/2012 Muhlhausen
D656,575 S 3/2012 Muhlhausen
D656,576 S 3/2012 Muhlhausen
D659,793 S 5/2012 Muhlhausen
8,181,282 B2 5/2012 Butter-Jentsch et al.
D662,174 S 6/2012 Reijnders
8,316,471 B2 11/2012 Pessel et al.
D679,778 S 4/2013 Gerhards
D685,545 S 7/2013 Ono et al.
D689,167 S 9/2013 Gerhards
D698,004 S 1/2014 Bruining et al.
8,695,124 B2 4/2014 Hsu
D720,427 S 12/2014 Wang et al.
D720,428 S 12/2014 Wang et al.
D720,830 S 1/2015 Wang et al.
D722,154 S 2/2015 Muller et al.
D724,778 S 3/2015 Hulan
8,987,182 B2 3/2015 Warkotsch et al.
D748,222 S 1/2016 Gerhards
D758,008 S 5/2016 Kolby et al.
9,334,640 B2 5/2016 Burt et al.
D760,991 S 7/2016 Ajmera et al.
D762,810 S 8/2016 Venini
D772,374 S 11/2016 Bruining
D772,375 S 11/2016 Bruining
D784,491 S 4/2017 Hale et al.
D787,631 S 5/2017 Gerhards
D787,632 S 5/2017 Gerhards et al.
D787,633 S 5/2017 Gerhards et al.
D788,257 S 5/2017 Gerhards et al.
D788,258 S 5/2017 Gerhards et al.
D788,259 S 5/2017 Gerhards et al.
D788,260 S 5/2017 Gerhards et al.
D788,261 S 5/2017 Gerhards et al.
D788,262 S 5/2017 Gerhards et al.
D789,485 S 6/2017 Hale et al.
D789,486 S 6/2017 Gerhards et al.
D789,487 S 6/2017 Gerhards et al.
D790,034 S 6/2017 Gerhards et al.
D790,035 S 6/2017 Gerhards et al.
D790,036 S 6/2017 Gerhards et al.
D790,037 S 6/2017 Gerhards et al.
D790,038 S 6/2017 Gerhards et al.
D790,658 S 6/2017 Gerhards et al.
D791,273 S 7/2017 Gerhards et al.
D791,274 S 7/2017 Gerhards et al.
D791,910 S 7/2017 Gerhards et al.
D795,386 S 8/2017 Warden et al.
D795,387 S 8/2017 Gerhards et al.
D795,388 S 8/2017 Gerhards et al.
D795,389 S 8/2017 Gerhards et al.
9,725,686 B2 8/2017 Hochkugler et al.
D809,710 S 2/2018 Reda et al.
D811,654 S 2/2018 Nicoline
D814,117 S 3/2018 Groning
2001/0004775 A1 6/2001 Falchieri
2002/0083514 A1 7/2002 Lhoste
2002/0178493 A1 12/2002 Varanasi et al.
2003/0088908 A1 5/2003 Falchieri
2003/0207964 A1 11/2003 Gazzaniga et al.
2004/0068782 A1 4/2004 Butter-Jentsch et al.
2004/0107484 A1 6/2004 Butter-Jentsch et al.
2004/0221378 A1 11/2004 Conway et al.
2005/0014668 A1 1/2005 Bariou et al.
2006/0137081 A1 6/2006 Ferrara et al.
2007/0204387 A1 9/2007 Cornelius et al.
2008/0313795 A1 12/2008 Lu
2010/0192291 A1 8/2010 Burt et al.
2010/0212074 A1 8/2010 Burt et al.
2010/0235976 A1 9/2010 Cooper et al.
2010/0299818 A1 12/2010 Lu
2011/0099698 A1 5/2011 Butter-Jentsch et al.
2011/0138526 A1 6/2011 Hsu
2012/0047640 A1 3/2012 Warkotsch et al.
2012/0266368 A1 10/2012 Butter-Jentsch et al.
2012/0266369 A1 10/2012 Butter-Jentsch et al.
2012/0266370 A1 10/2012 Butter-Jentsch et al.
2013/0104304 A1 5/2013 Wilson et al.
2013/0239313 A1 9/2013 Schiedel et al.
2015/0167282 A1 6/2015 Lehmann et al.
2017/0181585 A1 6/2017 Khamis et al.
2017/0181934 A1 6/2017 Khamis et al.
2017/0226723 A1 8/2017 Muehlhausen et al.

(56) References Cited

U.S. PATENT DOCUMENTS

FOREIGN PATENT DOCUMENTS

| | | | |
|---|---|---|---|
| CN | 00250078 | | 9/2000 |
| CN | 2006260877 | | 6/2006 |
| CN | 2006260878 | | 6/2006 |
| CN | 300980775 | | 8/2009 |
| CN | 102421885 | A | 4/2012 |
| CN | 106957745 | A | 7/2017 |
| CN | 104583500 | B | 8/2017 |
| DE | 40105069-0001 | | 11/2001 |
| DE | 102009003088 | A1 | 11/2010 |
| EM | 001226989-0003 | | 11/2010 |
| EM | 0019735790001 | | 1/2012 |
| EM | 0019735790003 | | 1/2012 |
| EM | 002133314-0001 | A1 | 11/2012 |
| EM | 002251405-0001 | | 6/2013 |
| EM | 001941667-0001 | | 1/2014 |
| EM | 001941667-0002 | | 1/2014 |
| EM | 002597542-0004 | | 2/2015 |
| EM | 002597542-0008 | | 2/2015 |
| EM | 002619361-0006 | | 2/2015 |
| EM | 002619361-0008 | | 2/2015 |
| EP | 0878586 | A2 | 11/1998 |
| EP | 0940509 | | 9/1999 |
| EP | 0960984 | A2 | 12/1999 |
| EP | 1334239 | | 8/2003 |
| EP | 2132383 | | 12/2009 |
| EP | 1789099 | | 2/2010 |
| EP | 2183439 | | 5/2010 |
| EP | 2227604 | | 9/2010 |
| EP | 2305901 | | 6/2011 |
| EP | 0019735790002 | | 1/2012 |
| EP | 2305900 | | 8/2013 |
| EP | 2638137 | B1 | 8/2017 |
| EP | 2334878 | B1 | 10/2017 |
| ES | I0151495 | | 5/2002 |
| ES | D0500876-01 | | 5/2005 |
| ES | 2368850 | T3 | 11/2011 |
| FR | 013262-001 | | 8/2001 |
| FR | 013262-002 | | 8/2001 |
| GB | 2097887 | A | 11/1982 |
| GB | 2100165 | A | 12/1982 |
| GB | 2356407 | A | 5/2001 |
| GB | 3018324 | | 7/2005 |
| GB | 3018327 | | 7/2005 |
| JP | 112323 | | 1/1955 |
| JP | S54-7749 | A | 1/1979 |
| JP | H7-37988 | U | 7/1995 |
| JP | 2004132109 | A | 4/2004 |
| JP | 2008030846 | A | 2/2008 |
| JP | 2012-526876 | A | 11/2012 |
| JP | 1499851 | | 6/2014 |
| JP | 1507648 | | 9/2014 |
| JP | 1579221 | | 6/2017 |
| JP | 1589992 | | 11/2017 |
| KR | 300761036.0000 | | 9/2014 |
| KR | 300767264.0000 | | 10/2014 |
| KR | 101736512 | B1 | 5/2017 |
| RU | 00084731 | U1 | 3/2013 |
| RU | 2494197 | C2 | 9/2013 |
| WO | 9824988 | A1 | 6/1998 |
| WO | 9840465 | A1 | 9/1998 |
| WO | 200050699 | | 8/2000 |
| WO | 0077310 | A2 | 12/2000 |
| WO | 2004010833 | A2 | 2/2004 |
| WO | 2004013419 | A1 | 2/2004 |
| WO | 2006013322 | A1 | 2/2006 |
| WO | 2006107053 | A1 | 10/2006 |
| WO | 08110221 | A1 | 9/2008 |
| WO | 2008120543 | A1 | 10/2008 |
| WO | 09086947 | A1 | 7/2009 |
| WO | 09086948 | A1 | 7/2009 |
| WO | 2009086947 | A1 | 7/2009 |
| WO | 2009086948 | | 7/2009 |
| WO | 2010018006 | | 2/2010 |
| WO | D073018-001 | | 7/2010 |
| WO | 2010130645 | A1 | 11/2010 |
| WO | D078587-001 | | 1/2012 |
| WO | D078587-002 | | 1/2012 |
| WO | D078587-003 | | 1/2012 |
| WO | D078588-001 | | 1/2012 |
| WO | D078588-002 | | 1/2012 |
| WO | D078588-003 | | 1/2012 |
| WO | D079761-001 | | 1/2012 |
| WO | D077855-001 | | 3/2012 |
| WO | D077855-002 | | 3/2012 |
| WO | 2012062914 | | 5/2012 |
| WO | 2013054124 | A1 | 4/2013 |
| WO | D079650-001 | | 6/2013 |
| WO | D079650-002 | | 6/2013 |
| WO | D079650-003 | | 6/2013 |
| WO | D079650-004 | | 6/2013 |
| WO | D079650-005 | | 6/2013 |
| WO | D079650-006 | | 6/2013 |
| WO | D079650-007 | | 6/2013 |
| WO | D079650-008 | | 6/2013 |
| WO | 2014029510 | A | 2/2014 |
| WO | D082756-001 | | 2/2014 |
| WO | 2014195045 | A1 | 12/2014 |
| WO | 2015048657 | A1 | 4/2015 |
| WO | D086545-001 | | 6/2015 |
| WO | D087100-001 | | 8/2015 |
| WO | D087100-002 | | 8/2015 |
| WO | D087100-003 | | 8/2015 |
| WO | D087100-004 | | 8/2015 |
| WO | D087100-005 | | 8/2015 |
| WO | D087100-006 | | 8/2015 |
| WO | D087100-007 | | 8/2015 |
| WO | D087100-008 | | 8/2015 |
| WO | D087341-002 | | 9/2015 |
| WO | D087341-003 | | 9/2015 |
| WO | D087341-004 | | 9/2015 |
| WO | D087341-005 | | 9/2015 |
| WO | D087341-006 | | 9/2015 |
| WO | D087341-007 | | 9/2015 |
| WO | D087341-008 | | 9/2015 |
| WO | D087533-001 | | 10/2015 |
| WO | D087533-002 | | 10/2015 |
| WO | D087533-004 | | 10/2015 |
| WO | D087533-005 | | 10/2015 |
| WO | D087533-006 | | 10/2015 |
| WO | D087533-007 | | 10/2015 |
| WO | D087533-008 | | 10/2015 |
| WO | 2016040341 | A1 | 3/2016 |
| WO | D088274-001 | | 5/2016 |

OTHER PUBLICATIONS

Tesco, "Duck 5In1 Rimblock", http://www.tesco.com/groceries/Product/Details/?id=278608564, Oct. 8, 2013, p. 1, published 2013.

myshopping.com.au, "2x Glade Perfume Toilet Block Lavender" http://www.myshopping.com.au/ZM-1234107356_2x_glade_perfume_toilet_block_lavender, Oct. 8, 2013, p. 1, published 2013.

FacePaintsDirect.co.uk, Jet Paint Splash Sponge Tear Drop, undated online product page, retrieved Mar. 11, 2018 from <URL:http :1/www. facepaintsdi rect.co .uk/jestpaintsplashspongeteardrop2pack. html > (Year: 20 17).

Feb. 22, 2018—(JP) Office Action—App No. 2017-513142.

Mar. 15, 2017—(AU) Examination Report—App 2015315352.

Apr. 25, 2018—(RU) Office Action—App No. 2017111624.

Jun. 5, 2018—(AU) Examination Report—App. No. 2018201873.

May 23, 2017—(RU) Office Action—App 2017111624.

Dec. 7, 2015—(WO) International Search Report PCT/US2015/048976.

Jul. 23, 2018—First Chinese Office Action—App 201580055427.4 with partial English translation.

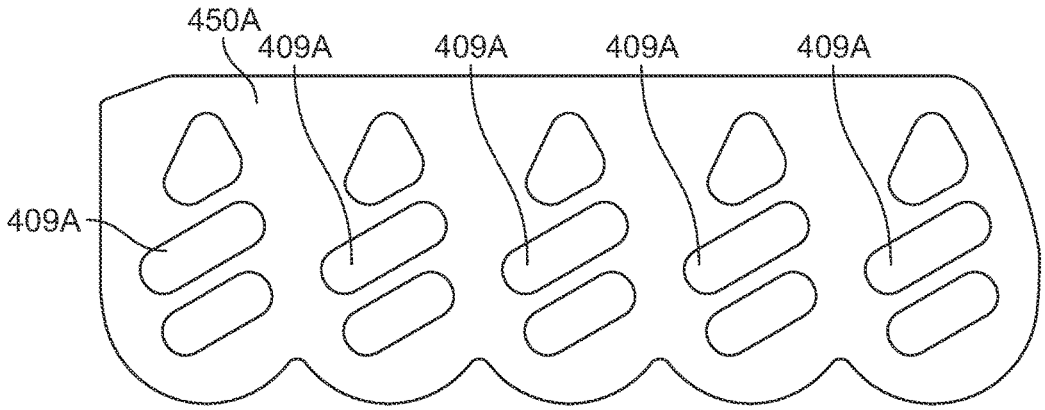
FIG. 4E1
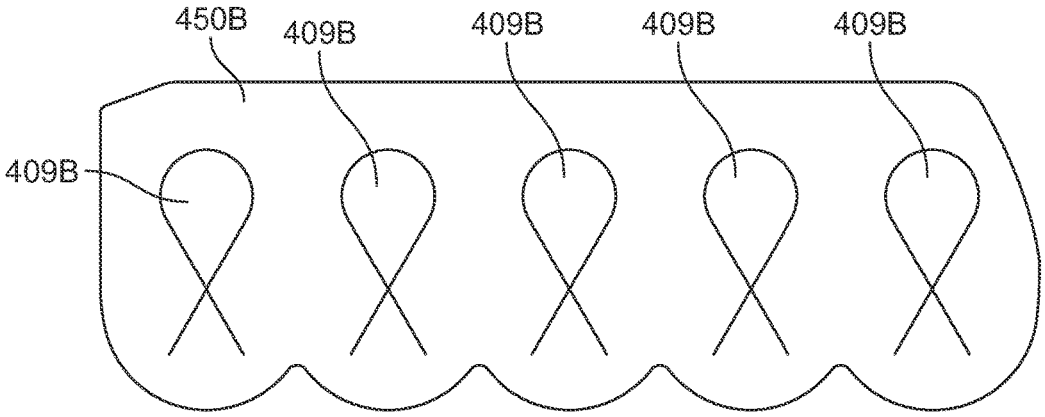
FIG. 4E2
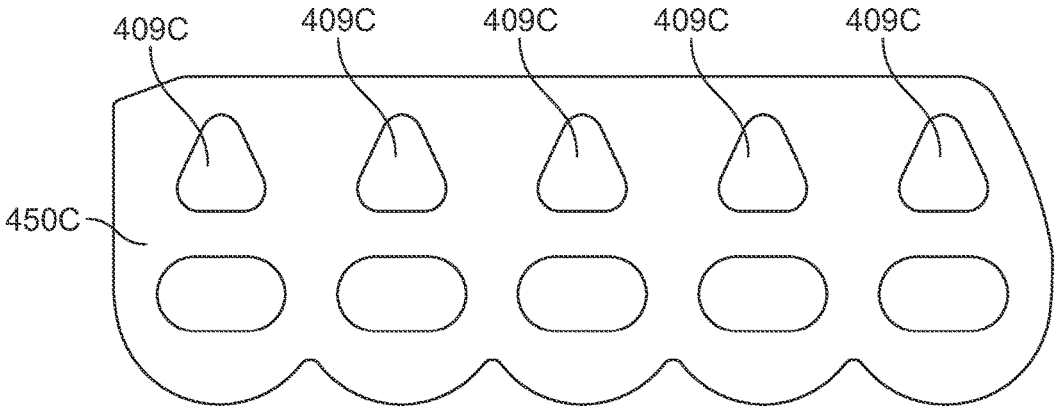
FIG. 4E3

TOILET RIMBLOCK AND METHOD OF MAKING SUCH RIMBLOCK

CROSS-REFERENCE TO RELATED APPLICATIONS

This application claims priority to U.S. Application No. 62/047,312 filed on Sep. 8, 2014, U.S. Application No. 62/092,694 filed on Dec. 16, 2014, and U.S. Application No. 62/140,120 filed on Mar. 30, 2015, all of which are incorporated in their entirety as is set forth fully herein.

The present disclosure is related to U.S. patent application Ser. No. 11/673,661, now U.S. Pat. No. 7,709,433, U.S. patent application Ser. No. 12/388,576, now U.S. Pat. No. 8,143,205, and U.S. patent application Ser. No. 13/374,700, now U.S. Pat. No. 8,658,588, all of which are incorporated by reference in their entirety as is set forth fully herein.

TECHNICAL FIELD

The present disclosure generally relates to a device for dispensing a product into the bowl of a toilet. In particular, it relates to a device adapted to be hooked on the rim of a toilet bowl such that as the toilet is flushed the product is dispensed directly into the toilet bowl.

BACKGROUND

Agents for treating (e.g., cleaning, sanitizing, deodorizing, fragrancing, etc.) surfaces of bathroom appliances such as toilets can be in the form of solids, pastes, gels, powders and liquids. Liquid formulations delivered in squeeze bottles allow for periodic treating of the appliance and typically require a consumer to reapply the sanitary agent each time the appliance is to be cleaned. Other products that demand less time by the consumer allow for automatic or continuous treating of the appliance.

A rimblock is a solution for continuous treatment every time when an appliance such as a toilet is flushed. For example, disintegrating blocks containing various components can be used for cleaning, sanitizing, deodorizing and/or fragrancing toilets or urinals. Such disintegrating blocks generally are immersed in the water tank (also known as the cistern) of a toilet or urinal, or are placed in a holder of some sort and then put "under-the-rim" (UTR) of the toilet bowl or urinal. Once put into place, either in the cistern or in the toilet bowl or urinal, the block slowly releases active ingredients and disintegrates into the water. In the case of a disintegrating block placed into the cistern, the block may fall to the bottom of the cistern, and then constantly be bathed with water. Such constant contact with the water requires a formulation of a certain type to ensure that the disintegrating block releases active ingredients and disintegrates at an appropriate rate. In the case of UTR products, such disintegrating blocks will disintegrate and release active ingredients each time that the toilet is flushed and the block is rinsed with the flush water. Many disintegrating blocks may be placed into the toilet tank (cistern), either by placing the block into a dispenser, or by simply placing the block in the tank. Automatic or continuous cleaning may also afforded by suspending a sanitary agent in baskets that hang from the appliance or toilet rim.

SUMMARY

This Summary provides an introduction to some general concepts relating to this disclosure in a simplified form that are further described below in the Detailed Description. This Summary is not intended to identify key features or essential features of the disclosure.

Aspects of the disclosure herein relate to dispensers having one or more compartments for receiving material formulations. The formulations can be different from each other, to provide different functions or can be similar to each other. For example, the formulations can include one or more of a cleaner or fragrance, can be in a gel, paste or solid form, and can be different colors to appeal to customers. A hanger can be configured to suspend the tray from a toilet bowl rim. In one example, the cover can be incorporated into a packaging such that when the tray is removed from the packaging, the at least one compartment is exposed. Additionally, in certain examples, the tray and the at least one compartment can be transparent and can form part of the packaging.

In another example, a dispenser system may include a tray having at least one teardrop-shaped compartment having a formulation. The compartment may include an aperture for receiving fluid, and the formulation may include one of a cleaner or fragrance. A hanger can be provided for suspending the tray from a toilet bowl rim. A casing may also be provided that may be configured to cover at least a portion of the at least one compartment and at least a portion of the formulation to allow for fluid to interact with the formulation and dissolve the formation into the fluid. In one example, the tray and the cover can be thermoformed. In another example, the tray can be thermoformed and the casing can be injection molded. Alternatively, the tray and the cover can both be injection molded. In certain examples, a hinge can connect the casing to the tray, and the hinge can be configured to open to remove the casing from the tray

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears. Exemplary embodiments of the disclosure will now be described by way of example only and with reference to the accompanying drawings, in which.

DETAILED DESCRIPTION

In the following description of various example structures in accordance with the disclosure, reference is made to the accompanying drawings, which form a part hereof, and in which are shown by way of illustration of various structures in accordance with this disclosure. Additionally, it is to be understood that other specific arrangements of parts and structures may be utilized, and structural and functional modifications may be made without departing from the scope of the present disclosure. Also, while the terms "top," "bottom," "upper," "lower," "rear," "front," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention. Moreover, the figures of this disclosure may represent the scale and/or dimensions according to one or more embodiments, and as such contribute to the teaching of such dimensional scaling. However, those skilled in the art will readily appreciate that the disclosure herein is not limited to the scales, dimensions, proportions, and/or orientations shown in the figures.

Figure 1A:
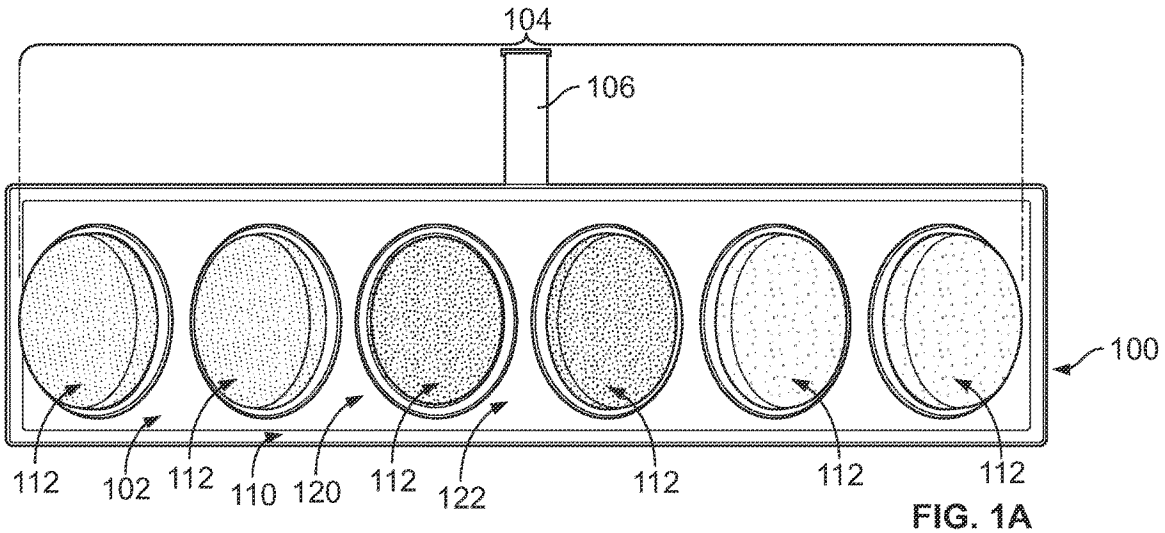
FIG. 1A depicts a front view of an example dispenser.
Figure 1B:
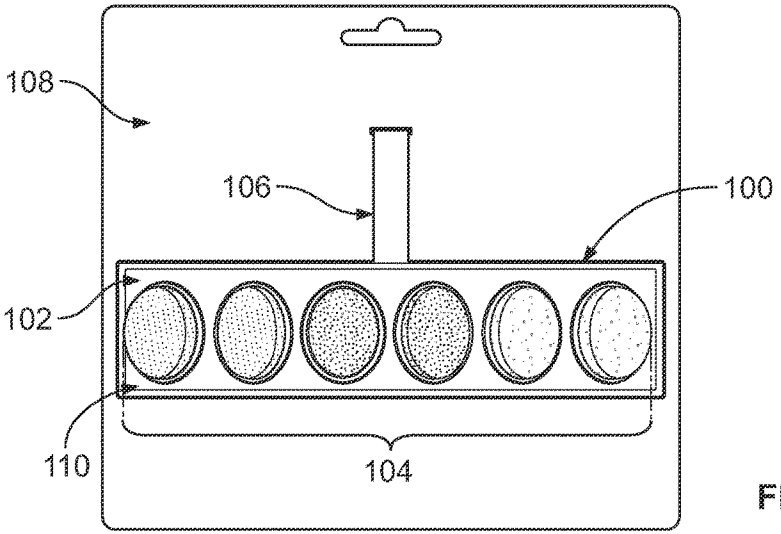
FIG. 1B illustrates a front view of the example dispenser in an alternative packaging arrangement.

FIGS. 1A and 1B depict an example dispenser 100. The example dispenser 100, when mounted to a toilet, is configured to provide a continuous treating (e.g., cleaning, sanitizing, deodorizing and/or fragrancing, etc.) each time the toilet is flushed. FIG. 1A shows the dispenser 100 in a first product packaging arrangement, and FIG. 1B shows the dispenser in a second product packaging arrangement. As can be seen from FIGS. 1A and 1B, the dispenser 100 can be in the form of a toilet rim block and can include a body or tray 102 having a wall 120 forming a rim 122 and an array of visually discrete and individual compartments 104.

The individual compartments 104 can be configured to receive individual sections of a treatment composition or material 112, which can be in the form of a gel, paste, and/or solid. The material 112 is formulated to provide one or more functions when exposed to flush water from the toilet. For example, the material 112 may be configured to clean, sanitize, deodorize and/or fragrance the toilet and/or its surroundings. The material 112 can also be configured to color the water within the toilet bowl and/or provide any other function that may be desirable for a user. Moreover, each section or block of material 112 can provide the same function as the other preparations of material 112 or can provide a different function. For example, in a first product form, all of the preparations of the material 112 may be formulated to clean and fragrance the toilet, while in a second product form, one or more preparations of the material 112 may be formulated to clean and the remaining preparations of the material 112 may be formulated to provide fragrancing. In both cases, the material 112 can be provided in different colors and/or fragrances in order to appeal to consumers. Each section or block of material can have a different material and/or chemical composition (e.g. different or additional active ingredient(s) and/or additives), and/or form (e.g. a gel or solid material for one block or a paste material for another). In one example, the tray 102 can be packaged pre-filled with material. It is also contemplated that the user can fill the tray 102 at home with a filling kit and/or other sources of a material, for example a bottle, reservoir, or container storing a larger amount of material that a user may store elsewhere. The tray 102 can be provided with a cover 110, which seals the individual sections of material 112 by providing a barrier against moisture and odor or fragrance prior to use. In one example, the cover 110 can be sealed to the rim 122 of the wall 120.

The dispenser 100 can also be provided with a hook or hanger 106 to hang the dispenser 100 in the toilet bowl during use. As shown in FIG. 1B, the hook or hanger 106 can be attached near an upper portion of the dispenser 100. The hook or hanger 106 may be attached to a front or a rear portion of the rim of a toilet bowl. During use, the tray 102 can be arranged such that the individual compartments 104 and the individual sections of material 112 are exposed to water when the toilet bowl is flushed, thereby causing the formulations in the individual sections of material 112 to release within the water of the toilet bowl. In an alternative example, the body 102 can additionally be provided with holes or apertures by which water may enter and/or leave the body 102 when the toilet bowl is flushed.

The individual compartments 104 can be oblong or oval shaped. However, other shapes are contemplated, e.g. circular, rectangular, triangular, spherical, teardrop, etc. In one example, the individual compartments 104 can be arranged in a horizontal row. It is also contemplated that the individual compartments 104 of the dispenser 100 can be arranged in a vertical column or in a diagonal arrangement. In addition, the body 102 can be formed with a degree of flexibility to accommodate for the curvature of the toilet bowl and may also include a predetermined degree of curvature to accommodate for the curvature of the toilet bowl.

The body 102 and the hook 106 can be formed in separate molding operations or in a single molding operation from a suitable material as discussed in further detail below, such as flexible or rigid plastic including, but not limited to, thermoformed plastic. In addition, the body 102, the compartments 104, and the hanger 106 can be formed by thermoforming or injection molding. The material used to form the body 102 and the compartments 104 can be formed of a temperature-appropriate material for a 70° C. formulation/material such that the compartments 104 can be filled with a hot solution to form the material 112.

In the example shown in FIGS. 1A and 1B, prior to use of the dispenser 100, the user detaches the cover 110 from the body 102 to expose the material 112 disposed in the individual compartments 104. The user then places the hanger 106 supporting the body 102 over the rim of a toilet such that the material 112 disposed in the individual compartments 104 faces inward toward the bowl or outwardly from the bowl. When the toilet is flushed, water will come into contact with the material 112 in the individual compartments, to cause the material 112 to dissolve and release into the bowl. In this way, each time the toilet is flushed, the material 112 can treat the bowl in a continuous manner. In particular, the sections or blocks of material 112 may help to remove stains, remove odors, sanitize the toilet, color the toilet water and/or provide a fragrance to the user depending on the particular formulation for each of the sections of the material 112.

As shown in FIG. 1A, in one example, to help to improve the appearance of the dispenser 100 on the shelf and to stand out to prospective consumers, the body or tray 102 can be mounted to cover 110, which can be a film or backing for sealing the openings of the tray 102. The cover 110, in combination with the material 112 in the individual compartments 104, can help the dispenser 100, packaged as a consumer product, stand out. In one example, the tray 102 is formed of a transparent or translucent material and the material 112 is formed as a transparent or translucent gel. In such an example, the cover 110 is formed of a foil/lidstock or other colored material that provides a reflective and/or contrasting background to the material 112. In this way, when the consumer shops the dispenser 100, the user will be able to see the material 112 through the tray 102 and the cover 110 will help highlight the material 112 in the dispenser 100. For example, the surface finish of the cover 110 may allow the material 112 to appear brighter or shinier on the shelf than when the dispenser 100 gets installed on a toilet. In another example, wherein the material 112 has different colors, the consumer will readily see the different colored material 112 and may infer that each section or block of material 112 serves a different function where different materials are disposed in the compartments 104.

In one example, the cover 110 can be made of multilayer foil, a metalized barrier film such as a metal foil for example aluminum foil, plastic film, or combinations thereof. Examples of polymers used to form plastic films include, but are not limited to, polyethylene, polypropylene, polyethylene terephthalate, polybutylene terphthalate, polyethylene naphthalate, polyesters, polycarbonates, polystyrene, acrylics, polyurethanes, polyvinyl chloride, polyvinyl fluoride, and mixtures and copolymers thereof. In one embodiment, the cover 110 can be formed to have a tab (not shown) that can used to facilitate the removal of the cover 110. It is also contemplated that the cover 110 can be formed of a biodegradable or other environmentally compatible materials.

In another example, as shown in FIG. 1B, the cover 110 can be incorporated into secondary packaging 108, which can be a cardboard backing, blister card, or cardstock, and the body 102 can be mounted directly to the secondary packaging 108. In this example, to use the dispenser 100, a user peels the body or tray 102 off of the secondary packaging 108 to expose the material 112. In this example, since the cover 110 is incorporated into the secondary packaging 108, a separate seal does not need to be applied to the body or tray 102 to seal the material 112 in the individual compartments 104. Additionally, mounting the body or tray 102 directly to the secondary packaging 108, and arranging the body 102 facing outwardly, eliminates the need for a separate blister card on the outer side of the packaging to cover the tray 102. Therefore, in this example, the body or tray 102 itself can function as the blister card and reduce packaging costs.

The dispenser 100 can be designed such that when the cover 110 is removed, the user does not inadvertently remove the contents of the tray 102. In one example, the individual compartments 104 can be partially filled or filled near to the rim 122 of the tray 102 such that the user does not inadvertently remove the material 112 from the tray 102. In another example, the cover 110 can have a low friction surface that does not adhere to the material 112 of the tray 102 or the cover 110 can adhere to the material 112 such that the bond between the cover 110 and the material is weaker than the bond between the material 112 and the tray 102. Including a coating or additional layer on the cover 110 or the material 112 to reduce the adhesion between the cover 110 and the material 112 is also contemplated to prevent the user from inadvertently removing the material 112.

In addition, one or more ramps can be incorporated into the top portion of the tray to direct water into and over the tray to ensure that the material disposed in the compartments is adequately exposed to water.

In another example, the individual compartments and material can be formed in alternate ornamental shapes in order to attract the consumer. For example, the shapes of the compartments and the material can be formed in a shape of a graphic mark, symbol, company logo, design, lettering, etc. Moreover, in addition to the above examples, the material can also be in the form of an extruded cylinder or extruded cylinders, coins, and/or blocks. The material can also have alternating colors or layered colors.

Figure 2A:
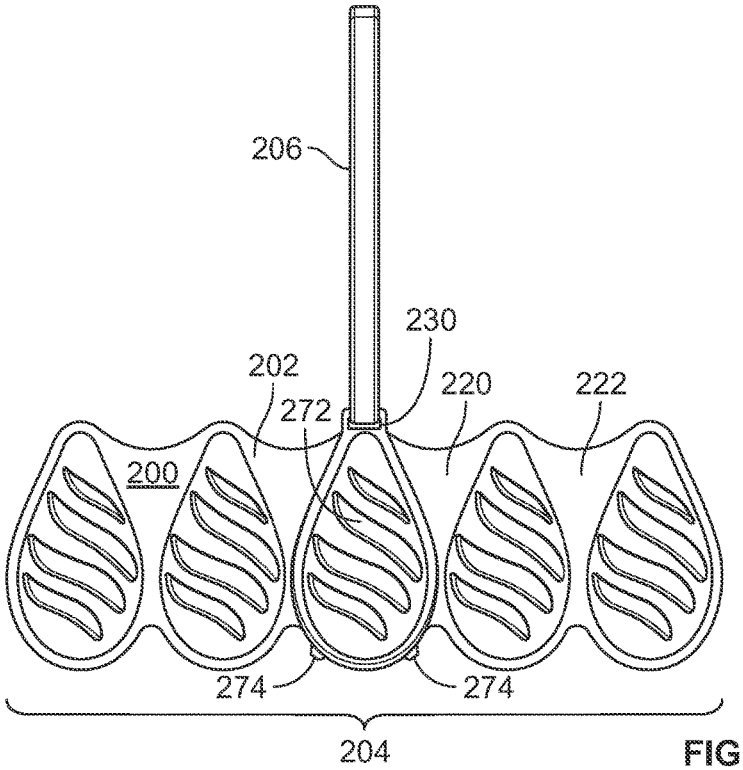
FIGS. 2A-2C depict another example dispenser.
Figure 2B:
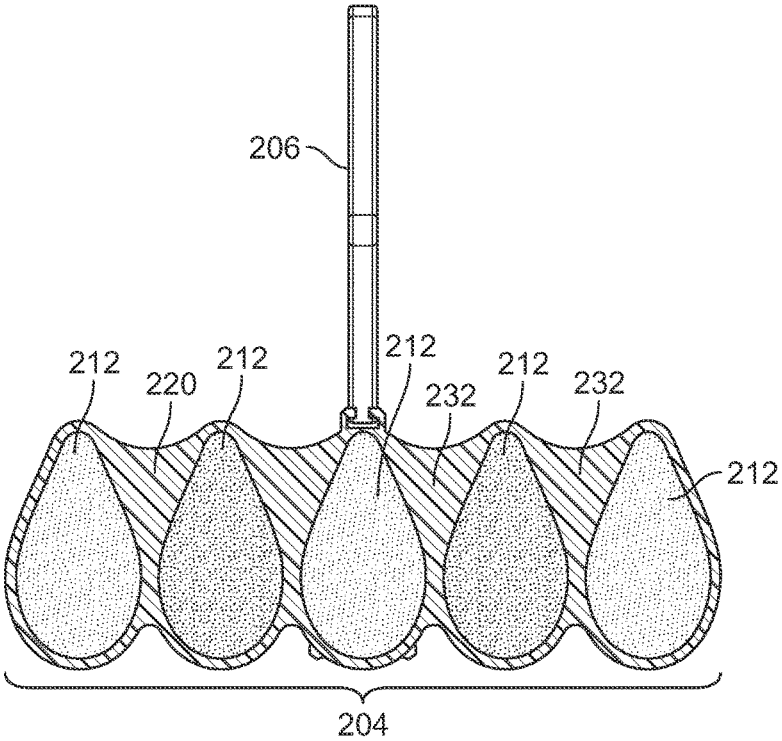
Figure 2C:
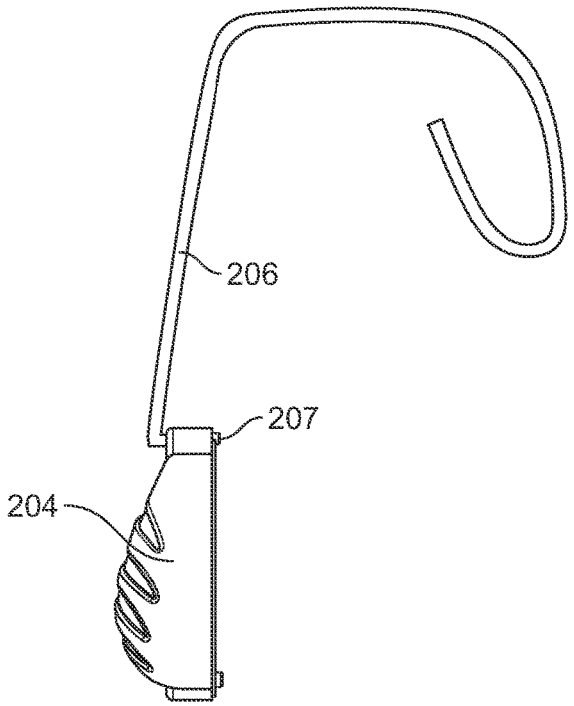

FIGS. 2A-2C depict another example dispenser 200, which is similar to the example dispenser described in relation to FIGS. 1A and 1B, where similar reference numbers are used to identify similar components. FIG. 2A shows a front view of the example dispenser 200. FIG. 2B shows a rear view of the dispenser 200. FIG. 2C shows a right-side view of the dispenser 200. The example dispenser 200 has similar features as the dispenser described in relation to FIGS. 1A and 1B; however, in this example, both the tray 202 and an optional casing, e.g., membrane, film, etc., (not shown) can be thermoformed, e.g., formed from plastic material in the form of one or more sheets of material by heating the plastic material to a malleable forming temperature such that the plastic material can be formed into the specific shape of a mold in the shape the dispenser 200 and casing. The materials can be formed of any suitable plastic in any desired color or can, like in the examples discussed herein, be formed of a transparent or translucent plastic material. The dispenser 200 and casing once formed may also be trimmed to create the final product.

Like in the above examples, the example dispenser 200, when mounted to a toilet, is configured to provide a continuous treatment each time the toilet is flushed. The dispenser 200 can also include a body or tray 202 which includes an array of individual compartments 204, and a wall 220. The dispenser 200 can also be provided with a hook or hanger 206, which can be attached near an upper portion of the dispenser 200.

Similar to the above examples, as shown in FIG. 2B, the individual compartments 204 can be configured to be formed open on one side to receive individual sections of material 212, which can be in the form of a gel, paste, and/or solid. In this example, however, an optional casing (not shown), which can be clear, opaque, or colored can be placed over the individual compartments 204. The casing, in this example is intended to remain on the dispenser 200 during use and may be provided with openings (not shown) to allow for the fluid from the toilet bowl to interact with the individual sections of material 212. The casing can be formed of any suitable material for thermoforming or other manufacturing techniques and may be formed of any of the materials discussed herein.

Additionally, the individual compartments 204 can be formed without openings on the opposite side of the dispenser to control the rate that the sections of material 212 dissolve in the toilet water. The compartments 204 can also be provided with ornamental patterns or shapes to enhance the appearance of the dispenser 200 to entice the consumer into purchasing the dispenser 200. Alternatively, like in certain examples discussed herein, both sides of the compartments 204 can also be provided with openings to allow for a quicker rate of release of the material 212 within the toilet bowl.

In this example, the individual compartments 204 can be formed in a teardrop shape; however, any other shape is contemplated in accordance with the disclosure herein. The teardrop shape of the individual compartments 204 provides a hydrodynamic shape of the dispenser 200 and ensures that the water flushing over the dispenser 200 does not dislodge the dispenser 200 from the toilet rim and into the toilet while adequately exposing the individual compartments 204 and their respective sections of material 212 to water.

The material 212 releases a treatment agent during use when exposed to water from a toilet. In this example, as shown in FIG. 2B, the compartments 204 can be provided with alternating material 212 of two different formulations and colors. However, each section or block of material 212 can provide a different function (e.g., cleaning, fragrancing, etc.) and can be provided in different colors and/or fragrances in order to appeal to consumers. In one example, the material 212 may fill less than 100% of the entire volume of the individual compartments. In particular, the individual compartments 204 may be filled to approximately 50% to 95% of the individual compartments 204. This creates head space between the optional casing and the individual blocks of material 212 to allow for the water to enter into the individual compartments 204 and to dissolve the individual blocks of material 212.

The wall 220 supports the individual compartments 204. In addition, as shown in FIGS. 2A-2C, the rim 222 can provide the tray 202 with one or more flat surfaces 232, which can form a sealing surface for sealing the tray 202 in packaging. As shown in FIG. 2A, the wall 220 can be formed with undulations that can correspond to the upper portions of the individual compartments 204. The wall 220 and the undulations help to direct water around the front and the rear of the dispenser 200. When the water is directed to the rear of the dispenser, it can interact with each section or block of material 212 and dissolve and release the treatment agent.

The hook or hanger 206 can be injection molded and may be attached to a front or a rear portion of the rim of a toilet bowl to hang the dispenser 200 in the toilet bowl. In this example, the dispenser 200 can be provided with a slot 230 for receiving an end of the hanger 206. Also as shown in FIG. 2C, the end of the hanger may also be provided with a bent or tapered portion 207 for preventing the hanger 206 from becoming detached from the dispenser 200. In this example, the hanger 206 can be attached to a retaining ring 272, which has one or more tabs 274 for securing the retaining ring 272 and the hanger 206 to the tray 202.

Although in the orientation shown, the blocks of material 212 will face the toilet bowl, it is contemplated that the hanger 206 can be attached to the dispenser 200 in the opposite orientation. Moreover, as is discussed in accordance with the examples below, it may in certain instances be desired to configure the dispenser 200 such that the blocks of material face inward toward the center of the toilet bowl, so the consumer can see the flushing water enter the compartments and interact with the material 212.

Figure 3A:
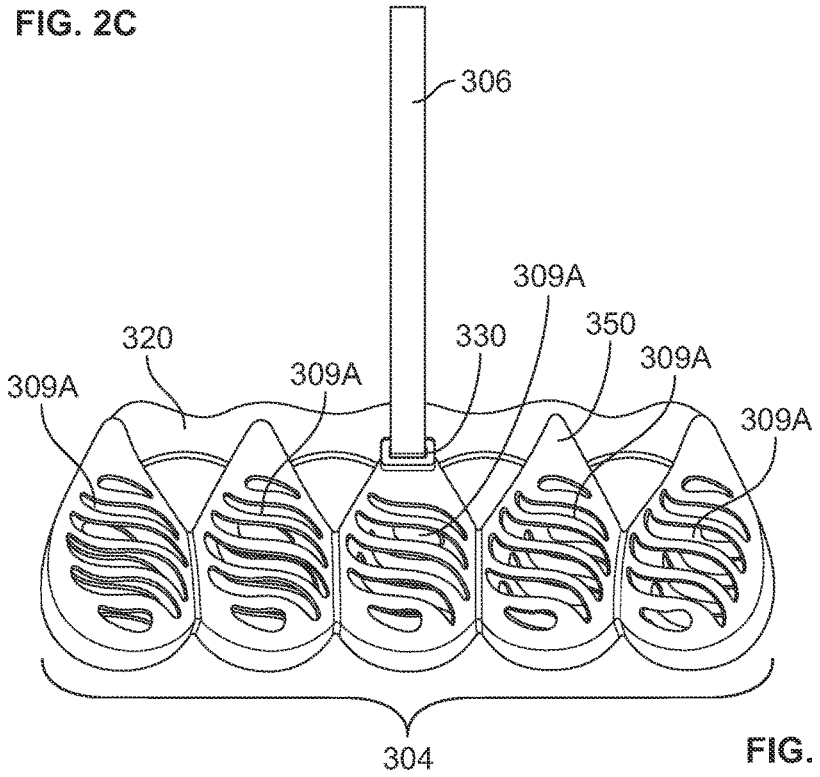
FIGS. 3A-3G depict another example dispenser.
Figure 3B:
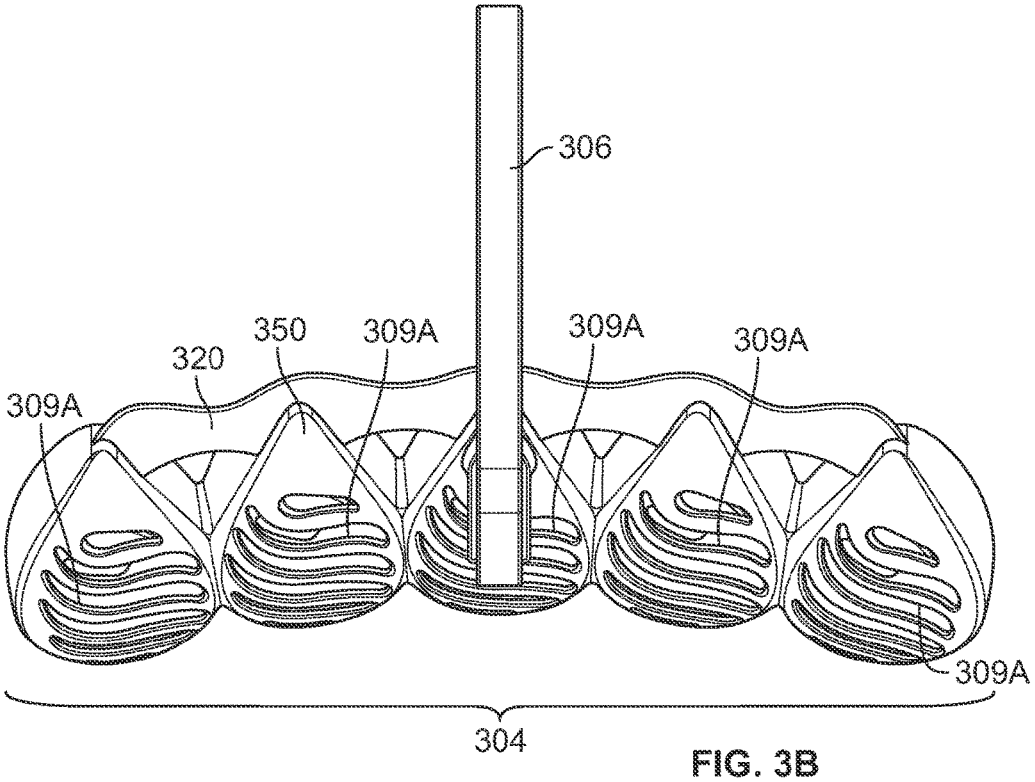
Figure 3C:
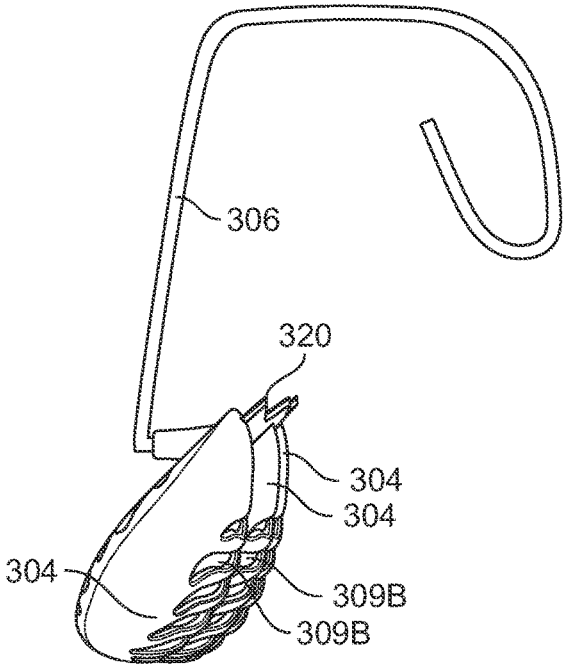
Figure 3D:
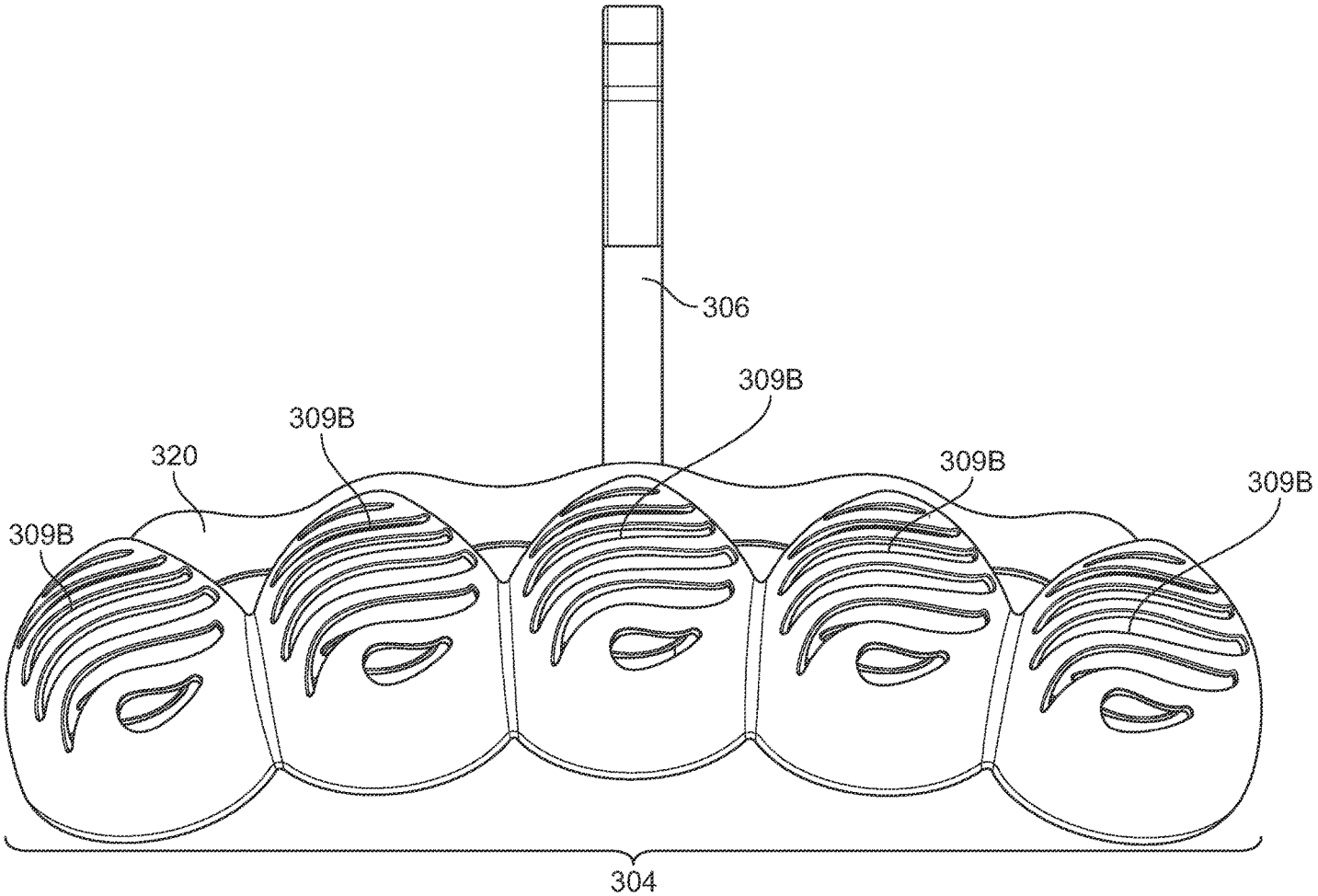
Figure 3E:
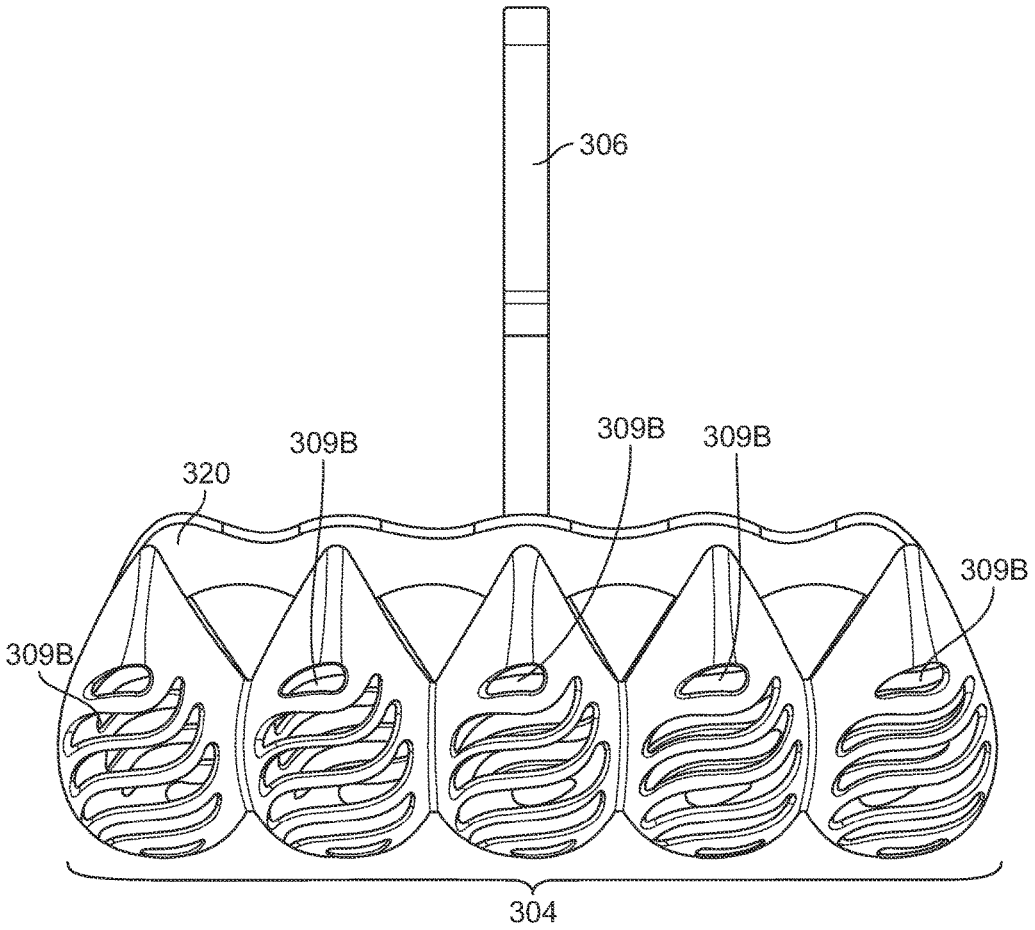
Figure 3F:
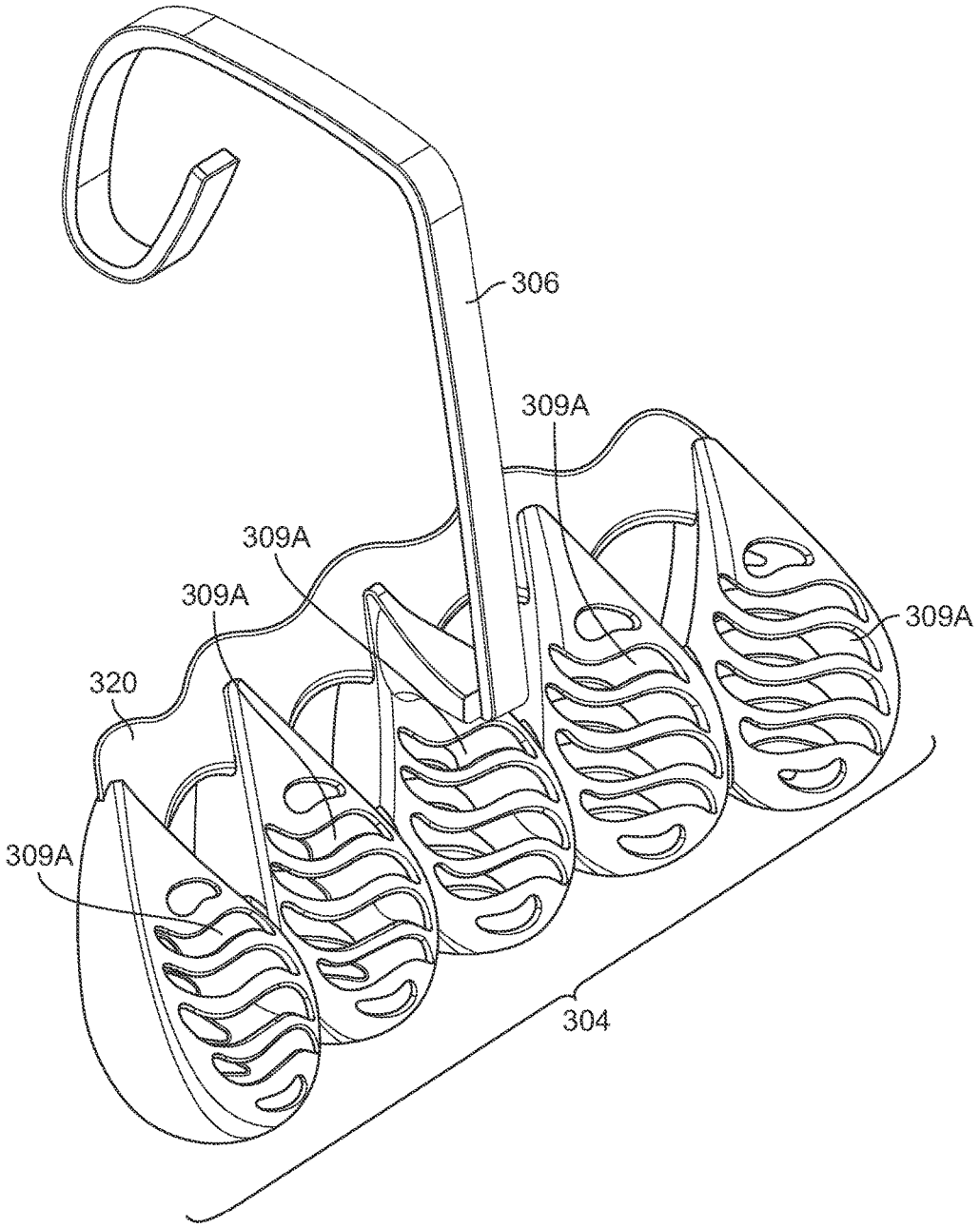
Figure 3G:
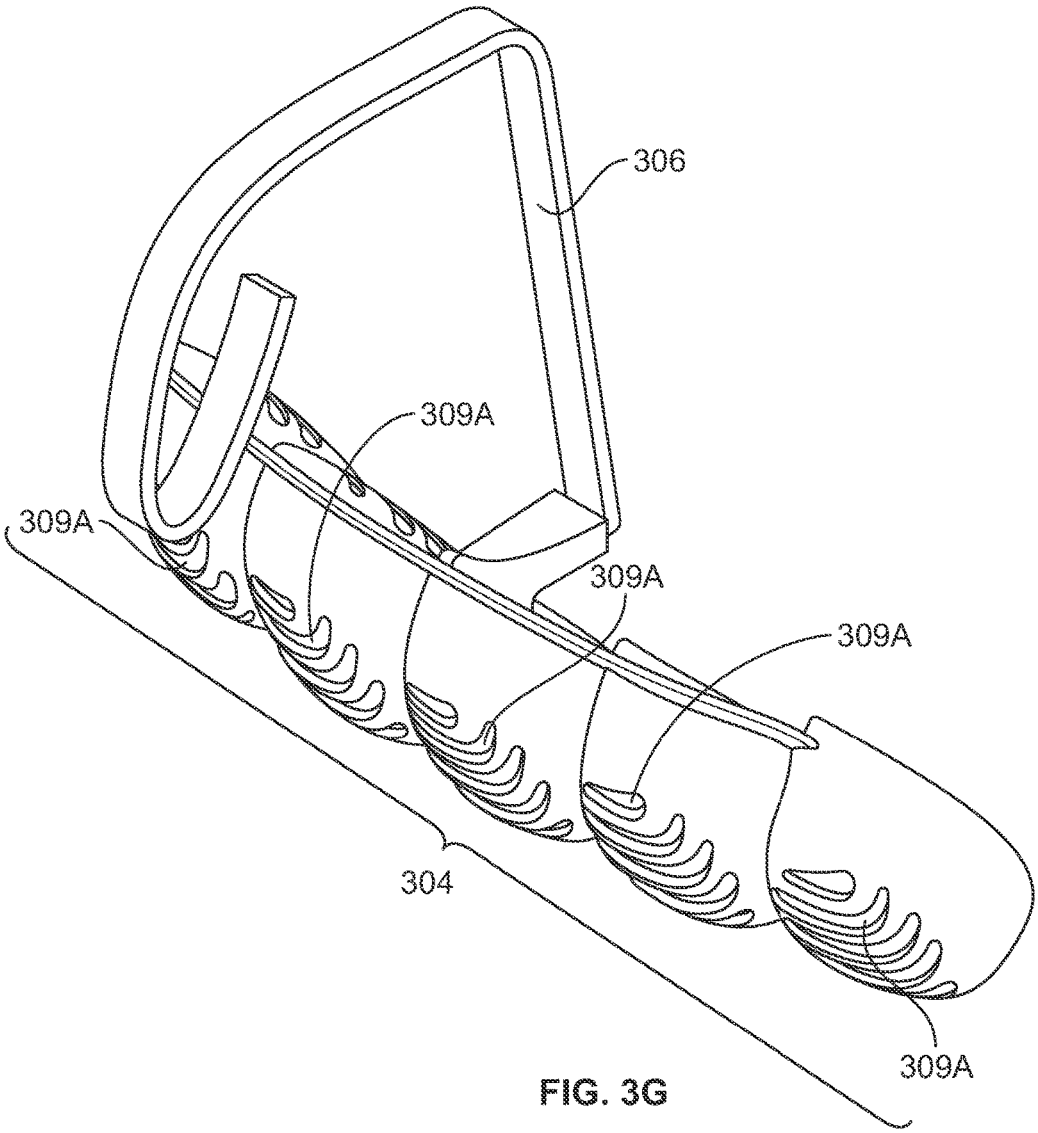

FIGS. 3A-3G depict another example dispenser 300, which is similar to the example dispenser described in relation to FIGS. 2A-2C, where similar reference numbers are used to identify similar components. FIG. 3A shows a front view of the example dispenser 300. FIG. 3B shows a front top perspective view of the dispenser 300. FIG. 3C shows a right-side view of the example dispenser 300. FIG. 3D shows a bottom, rear perspective view of the dispenser 300. FIG. 3E shows a rear view of the dispenser 300. FIG. 3F shows a front, left perspective view the example dispenser 300. FIG. 3G shows a top, rear, left perspective view of the example dispenser 300.

The example dispenser 300 has similar features as the dispensers above; however, in this example, the tray 302 and the casing 350 can be injection molded together as one component or unit. The material forming the dispenser can be formed of any suitable plastic in any desired color or can like in the examples discussed herein be formed of a transparent or translucent plastic material. Also in this example, as shown in FIGS. 3D and 3B, the dispenser 300 can be formed to include a radius of curvature that conforms to a radius of curvature of a toilet bowl.

Also in this example, a casing 350 is placed over the tray 302 to cover each of the individual compartments 304. The casing 350 can be placed over the front portion of each of the individual compartments 304 and can be provided with a series of openings or slits 309, such that the consumer can view the section of material 312 during use of the dispenser 300 in the toilet. In this example, as shown in FIG. 3A, the casing 350 can be raised above each cavity to create additional headspace between the material (not shown) and the casing 350. This allows for additional water to contact the material to enhance the treatment of the toilet bowl, to again create a visual effect for the user to see that the sections of material are working in the toilet bowl.

Unlike the example shown in FIGS. 2A-2C, the individual compartments 304 can be formed with openings 309*a*, 309*b* on both sides of the individual compartments 304. This may increase the rate that the sections of material dissolve in the toilet water. Again, the individual compartments 304 can be formed in a teardrop shape; however, any other shape is contemplated in accordance with the disclosure herein. The teardrop shape of the individual compartments 304 provides a hydrodynamic shape of the dispenser 300 and ensures that the water flushing over the dispenser 300 does not dislodge the dispenser 300 from the toilet rim and into the toilet while adequately exposing the individual compartments 304 and their respective sections of material 312 to water.

As in the previous examples, the compartments 304 can be provided with material of different formulations and colors, where each section or block of material 312 can provide a different function (e.g., cleaning, fragrancing, etc.) and can be provided in different colors and/or fragrances in order to appeal to consumers. Like in the above examples, the material may fill less than the entire volume of the individual compartments. In particular, the individual compartments 304 may be filled to approximately 50% to 95% of the reservoirs forming the individual compartments 304. This creates head space between the casing 350 and the individual blocks of material to allow for the water to enter into the individual compartments 304, to create a turbulent flow, and to dissolve the individual blocks of material 312.

In this example, as shown in FIGS. 3A and 3B, the wall 320 is formed integral with the casing 350 and the individual compartments 304 of the tray 302. Like in the above examples, the wall 320 can be configured to support the individual compartments 304 and can be formed with multiple undulations. In this example, however, the wall 320 can be formed of a smaller strip of material, and the individual compartments 304 and the wall 320 can define gaps in between each of the compartments.

The wall 320 and the undulations may allow for the dispenser to capture additional water flow from the toilet bowl during flushing and direct water into the openings 309*a*, 309*b* in the front and the rear of the individual compartments. In this way, the water flows into the openings 309*a*, 309*b* in the dispenser and interacts with each section or block of material. This causes each section of material to dissolve and release the treatment agents into the toilet bowl. Furthermore, water is allowed to flow in and around the gaps defined by the wall 320 and into the individual compartments 304.

Like in the above example described in relation to FIGS. 2A-2C, the hook or hanger 306 can be injection molded and may be attached to a front or a rear portion of the rim of a toilet bowl to hang the dispenser 300 in the toilet bowl. However, it is contemplated that the hanger be formed integral with the casing 350 and or tray 302. Also similar to the above examples, the dispenser 300 can be provided with a slot 330 for receiving an end of the hanger 306. Also the end of the hanger may also be provided with a bent or tapered portion (not shown) for maintaining the hanger from becoming detached from the dispenser. Since the openings 309*a*, 309*b* are provided in both the front and rear portions of the dispenser 300, the material in the individual compartments 304 can be viewed from either side and exposed to fluid on either side of the dispenser. Therefore, the consumer can see the blocks of material acting to treat the toilet bowl during use, which may in certain examples be desired.

In alternative examples, one or more of the above dispensers can be provided with a predetermined angle, which angles the tray of the dispenser toward the center of the toilet bowl. Additionally, the wall can be provided with the same predetermined angle. In one example, the angle can be approximately 45 degrees relative to the rim. However, it is contemplated that the angle could be anywhere from 0 degrees to 180 degrees depending on the desired water flow over the dispenser. The angled wall and the undulations help to direct water to the front of the dispenser. When the water is directed to the front of the dispenser, it can interact with each section or block material and dissolve and release the treatment agents.

Figure 4A:
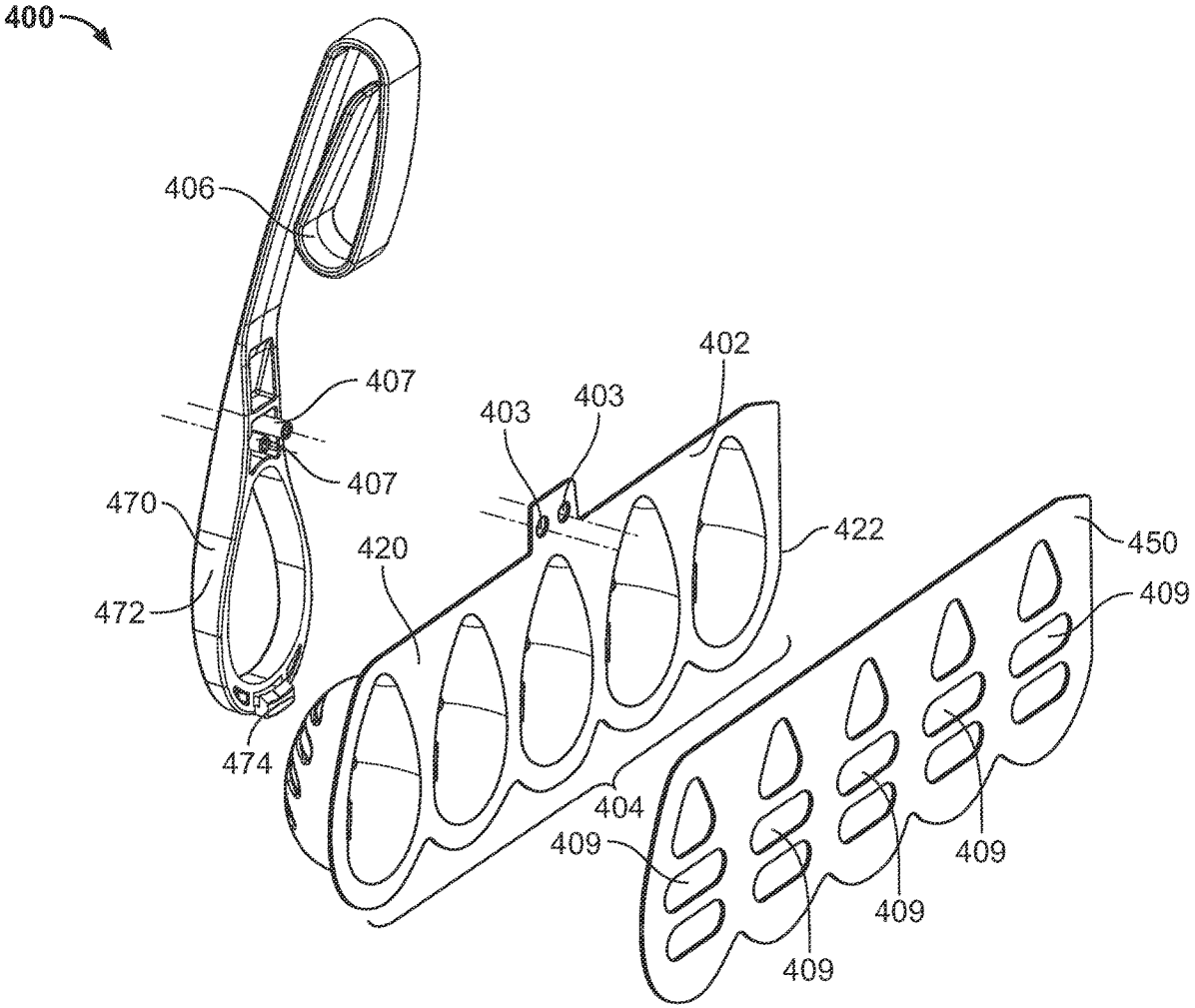
FIGS. 4A-4F depict another example dispenser.
Figure 4B:
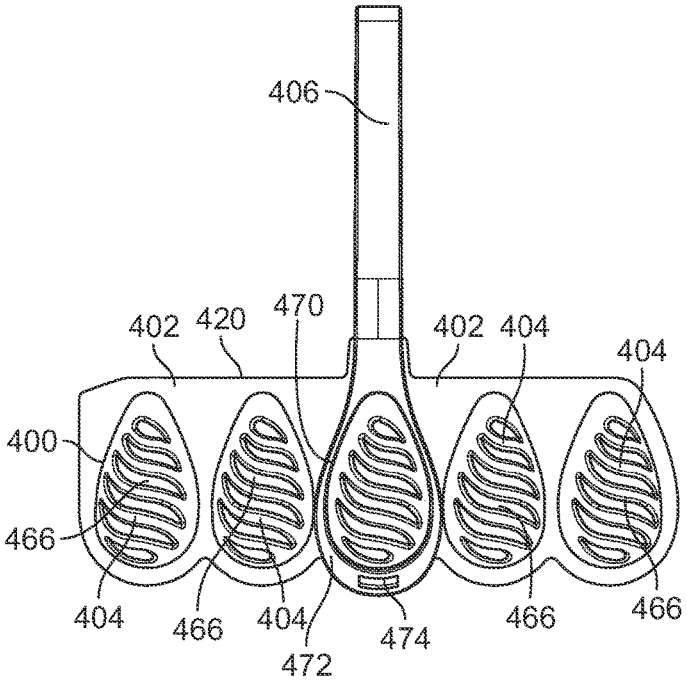
Figure 4C:
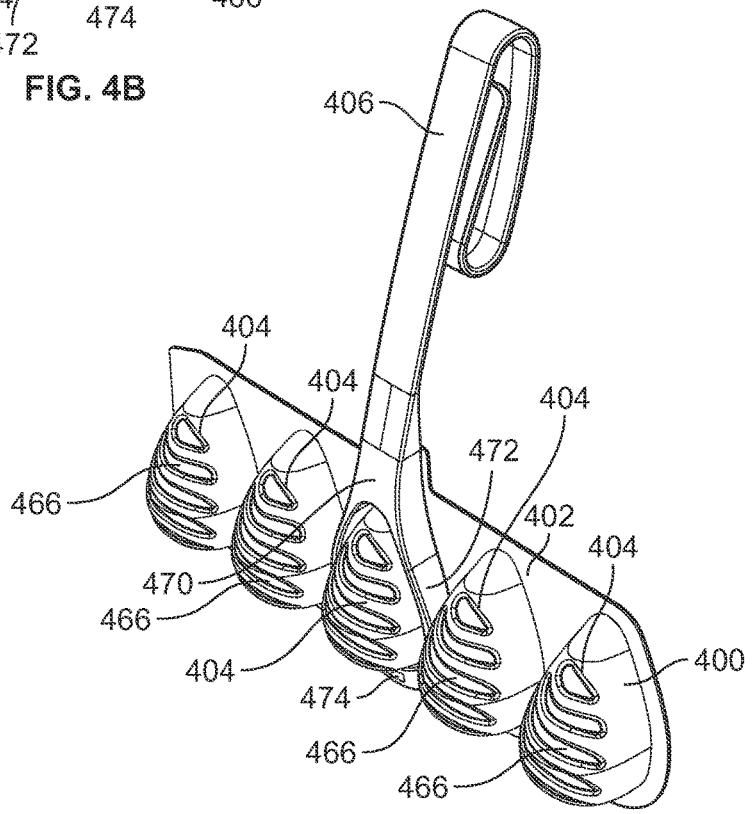
Figure 4D:
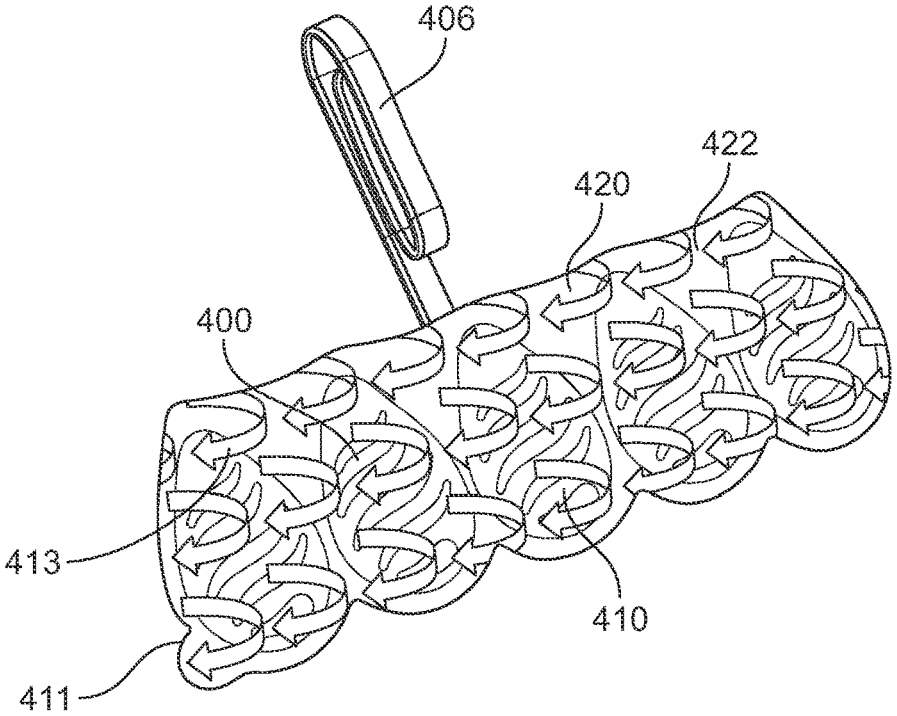
Figure 4E:
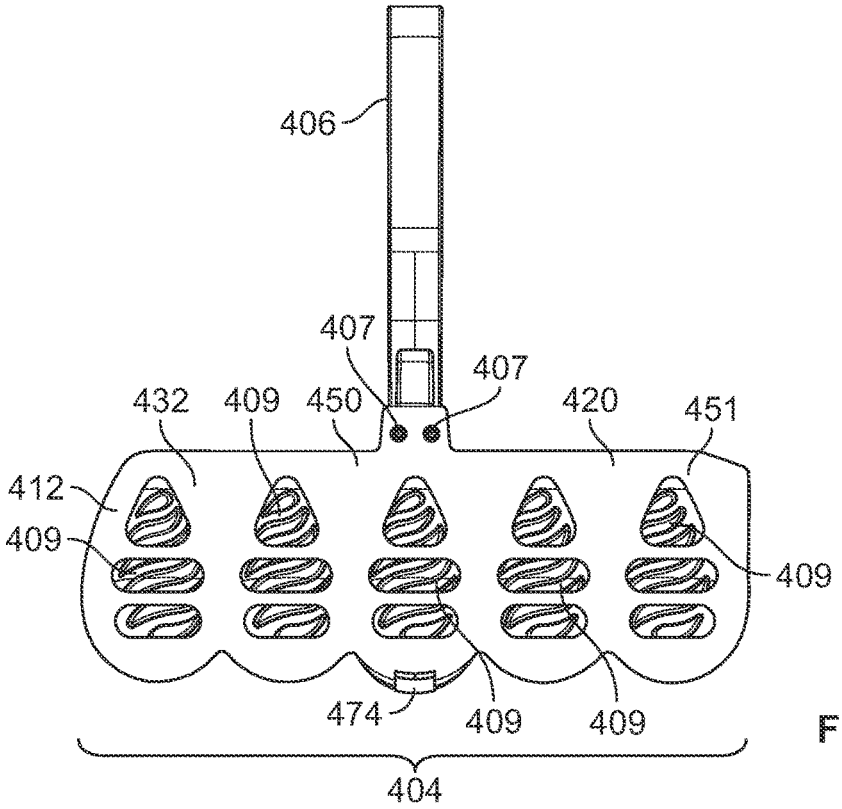
Figure 4F:
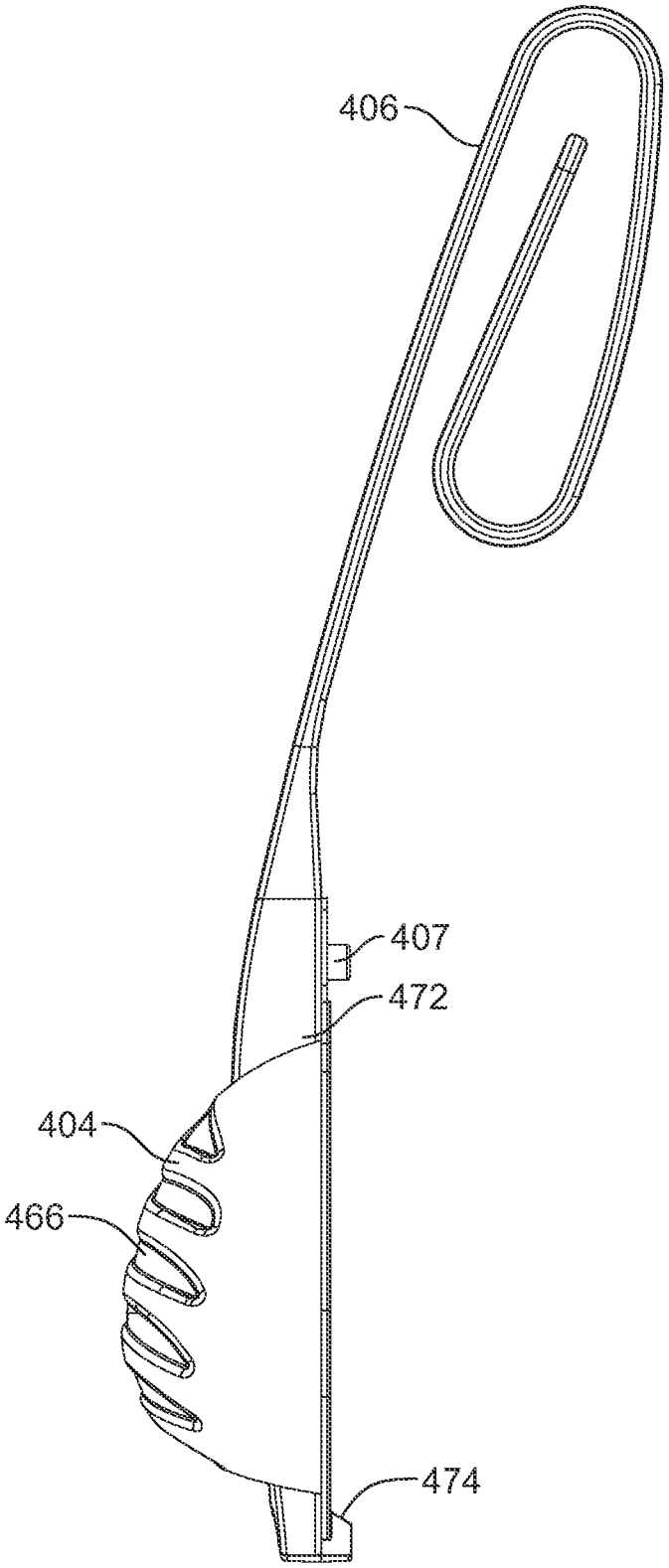

FIGS. 4A-4E depict another example dispenser 400, which is similar to the example dispensers described in relation to FIGS. 2A-3G. FIG. 4A shows an exploded view of the assembly of the example dispenser 400. FIG. 4B shows a front perspective view of the example dispenser 400. FIG. 4C shows another front perspective view of the example dispenser 400. FIG. 4D shows a rear perspective view of the example dispenser 400 with the cover 410 in place. FIG. 4E shows a rear perspective view of the example dispenser 400 with the cover 410 removed. FIGS. 4E1-4E3 show example opening patterns for example casings. FIG. 4F shows a left side view of the example dispenser 400.

The example dispenser 400 includes similar features and functionality as the example dispensers described in relation to FIGS. 2A-3G, where similar reference numbers are used to identify similar components and features. Like in the above examples, the example dispenser 400, when mounted to a toilet, is configured to provide a continuous treatment each time the toilet is flushed. Instead of forming each of the individual compartments 404 entirely open as in other examples discussed herein, the casing 450 (e.g., membrane, film, etc.) can be provided to cover the compartments 404 of the dispenser 400.

As shown in 4A, the dispenser 400 generally includes a tray 402, a casing 450, and a hook 406 integrally formed with a clip 470. As shown in FIGS. 4A-4F, like in the above examples, the tray 402 can include a wall 420, which can support the individual compartments 404. In this example and as discussed in more detail below, the clip 470 is configured to snap over a central compartment 404 to hold the hook 406 into place onto the tray 402. Also the casing 450 is configured to secure to the tray 402 over the compartments 404.

The hook or hanger 406 can be attached near an upper portion of the dispenser 400 and may be attached to a front or a rear portion of the rim of a toilet bowl to hang the dispenser 400 in the toilet bowl. The hook or hanger 406 can be injection molded together with the clip 470. In this example, as shown by FIG. 4D, the hook 406 and clip 470 can be positioned so that the casing 450 faces the wall of the toilet bowl when installed. However, it is also contemplated that the casing 450 can be configured to face toward the center of the toilet bowl when installed as illustrated by the other examples discussed herein. In certain examples, such as where the tray 402 and the casing 450 are formed transparent or opaque, the consumer can see the blocks of material 412 acting to clean and/or provide fragrance during use regardless of the orientation of the dispenser 400 in the toilet.

Referring specifically to FIGS. 4A, 4B, 4C, and 4E and as discussed above, the hook 406 can be integrally formed with a clip 470, which can be removably secured to the tray 402, for example, by an interference fit. In one example, the clip 470 can be provided with a retaining ring 472, which extends around a circumference of a central compartment 404. As shown in FIG. 4C, the central compartment 404 is configured to extend through the retaining ring 472.

The clip 470 can also be provided with a tab 474 for securing the clip 470 onto the tray 402. The tab 474 can extend over the tray 402 and past rim 422 such that the clip 470 is secured to the tray 402. In addition the tray 402 can include locating slots 403 for receiving corresponding projections 407 of the hook assembly. The projections 407 can be formed slightly larger in diameter than the slots 403 such that the clip remains in place on the tray 402. In this way, the tab 474 and the retaining ring 472 help to secure the clip 470 to the tray 402 by a friction or interference fit. Also, the casing 450 can be adhered to the tray 402. It is also contemplated that the hanger 406 and clip 470 could be formed reversible such that the user can adjust the orientation of the dispenser 400 in the toilet such that either the tray 402 or casing 450 faces the center of the toilet bowl.

It is also contemplated that in certain examples, the hanger 406 and clip 470 can be configured to snap into place over either the casing 450 or the tray 402 where it is desired to change the orientation of the dispenser 400 in the toilet bowl. In other examples, the hanger 406 and the clip 470 can be separately formed and then secured to the dispenser 400. In further alternate examples, the hanger could be integrally molded with the tray 402 or the dispenser 400 with or without a projection or clip.

Additionally, a cover 410 can be provided to seal the individual sections of material 412 by providing a barrier against moisture and odor or fragrance prior to use. The cover 410 can be configured to be removed by the user before the tray 402 is placed onto the toilet rim and may include a tab 411 or multiple tabs to facilitate the removal of the cover 410 from the tray 402. The casing 450 and/or the tray 402 can also be provided with a corresponding tab for supporting the tab 411 on the cover 410. The cover 410 can be made of any suitable materials, which can in one example be formed of any of the materials discussed in relation to the covers discussed herein. Additionally, the cover can be provided with certain indicia 413 to indicate to the user that the cover 410 is to be removed before use.

In this example, the tray 402, the casing 450, and the hook 406 can be thermoformed, e.g., formed from plastic material in the form of one or more sheets of material by heating the plastic material to a malleable forming temperature such that the plastic material can be formed into the specific shape of the molds forming the dispenser 400 and the casing 450. The materials can be formed of any suitable plastic in any desired color or can, like in the examples discussed herein, be formed of a transparent plastic material. Furthermore, in one example, the example dispenser 400 can be formed of PET. The tray 402 and casing 450 once formed may also be trimmed to create the final product. It is also contemplated that the tray 402 and the casing 450 can be formed with a predetermined radius of curvature in order to accommodate for the curvature of a toilet or formed flexible so as to accommodate for the curvature of the toilet bowl.

The casing 450, in this example, is intended to remain on the dispenser 400 during use, and the series of openings 409 allow for the fluid from the toilet bowl to interact with the individual sections of material 412 to dissolve the sections of material 412 into the toilet. The casing 450 can be placed over the rear portion of the tray 402 and can be secured to the tray 402 by an adhesive. In this example, the wall 420 and the rim 422 provide the tray 402 with one or more flat surfaces 432 for receiving the casing 450. In one example, the casing 450 can be sealed to the rim 422 of the wall 420. In this example, the wall 420 and the rim 422 can define an area of 4 $in^2$. In other examples, the area may be between approximately 2 $in^2$ and 6 $in^2$. In still other examples, the area may be greater or less than the dimensions provided.

The casing 450 can be configured to at least partially cover the openings of each of the individual compartments 404. The casing 450 can be provided with a plurality of openings or slits 409 in the areas covering the individual compartments 404. In one example, the size of the openings or slits 409 relative to the size of the openings of each of the individual compartments 404 can vary depending on the desired amount of formulation that is to be released into the toilet. In certain examples, the open area of the slits 409 over the total area of the apertures ranges from 40% to 60%. In other specific examples, the open area over the apertures 409 can be approximately 45%, 50%, or 52% of the total area of the products. The slits 409 can be formed elongated and/or may also be provided with a degree of curvature. As shown in the example in FIG. 4D, certain openings 409 can be formed in a triangular shape and certain openings can be formed as elongated openings extending parallel to each other.

Also as shown in FIG. 4E, in this example, the casing 450 can include a face 451, which can be formed substantially flat so as to reduce the profile of the dispenser 400 in the toilet. In contrast with certain examples discussed herein, the flat profile of the casing 450 can limit the amount of fluid exposure for each of the individual compartments 404, thereby slowing the rate that the formulations dissolve. The thinner profile of the dispenser 400 can also make the dispenser more economical to package.

In this example, the optional casing 450 can be formed of a clear material. However, the casing 450 can also be opaque or colored. The casing 450 can also be formed as a film. The casing 450 can be formed of any suitable material for thermoforming or other manufacturing techniques and may be formed of any of the materials discussed herein.

In this example, the compartments 404 can be provided with material 412 of the same formulation and color. However, like in the above examples, each section or block of material 412 can provide a different function (e.g., cleaning, fragrancing, etc.) and can be provided in different colors and/or fragrances in order to appeal to consumers. In certain examples, the compartments 404 can be filled to a certain percentage volume of formulation that is less than 100% and in one example, the percentage volume can range from 50% to 95%. This provides a certain headspace between the casing and the formulation, which allows for the water from the toilet to interact with the formulations. Additionally, the percentage volume can vary with respect to the particular compartment.

Other opening arrangements are contemplated depending on the desired water flow, desired dissolving rate of the formulations in the toilet, and appeal to the consumer. FIGS. 4E1-4E3 show additional alternative opening arrangements for exemplary casings. As shown in FIG. 4E1, the openings 409A in the casing 450A can be formed similar to the casing 450 above but can be formed at a slanted angle. Additionally, as shown in FIG. 4E2, the openings 409B of the casing 450B can be formed in a ribbon configuration where the openings are formed in the loop of the ribbon and the bottom portion of the ribbon can be embossed on the casing 450B. Moreover, in another example casing 450C shown in FIG. 4E3, the openings 409C can be formed in similar shapes as the example shown in FIG. 4E, however, the openings 409C on the bottom can be formed larger, and the number of openings can be fewer in numbers.

Additionally, as shown in FIG. 4B, the individual compartments 404 can be formed without openings on the opposite side of the dispenser to control the rate that the sections of material 412 dissolve in the toilet water. Moreover, the compartments 404 can also be provided with ornamental patterns or shapes to enhance the appearance of the dispenser 400 to entice the consumer into purchasing the dispenser 400. Specifically, the front of the tray 402 can be provided with a series of embossments 466. Alternatively, like in certain examples discussed herein, both sides of the compartments 404 can also be provided with openings to allow for a quicker rate of release of the material 412 within the toilet bowl. For example, the embossments 466 could be formed as openings or slots instead of embossments.

Like in above examples, the individual compartments 404 can be formed in a teardrop shape; however, any other shape is contemplated in accordance with the disclosure herein. Like in the above examples, the teardrop shape of the individual compartments 404 provides a hydrodynamic shape of the dispenser 400 and ensures that the water flushing over the dispenser 400 does not dislodge the dispenser 400 from the toilet rim and into the toilet while adequately exposing the individual compartments 404 and their respective sections of material 412 to water. Also as shown in FIG. 4E, the flat profile of the dispenser 400 can ensure that more water flows over the front side of the dispenser 400 than over the rear side, which can help control the rate that the material 414 within the compartments 404 dissolves in the toilet. It is contemplated that any number of compartments 404 can be used depending on the desired amount of formulation that is to be dispensed into the toilet. In this example, five compartments 404 are shown. Each of the compartments 404 can define a volume of approximately 0.4 $in^3$ and can have an internal cup area of approximately 2.3 $in^2$. In other examples, the volume may be between approximately 0.2 $in^3$ and approximately 0.6 $in^3$ and the internal cup area may be between approximately 0.1 $in^2$ and 0.3 $in^2$. In still other examples, the volume and the internal cup area may be greater or less than the dimensions provided. To use the dispenser 400, the user can pull on an optional the tab 411 of the cover and peel the cover 410 from the casing 450 and the tray 402 to expose the material 412 in the individual compartments 404. The user can then place the dispenser 400 onto the rim of a toilet, and the material 412 in the compartments 404 releases a cleaning agent and/or fragrance evenly during use when exposed to water from a toilet.

Figure 5A:
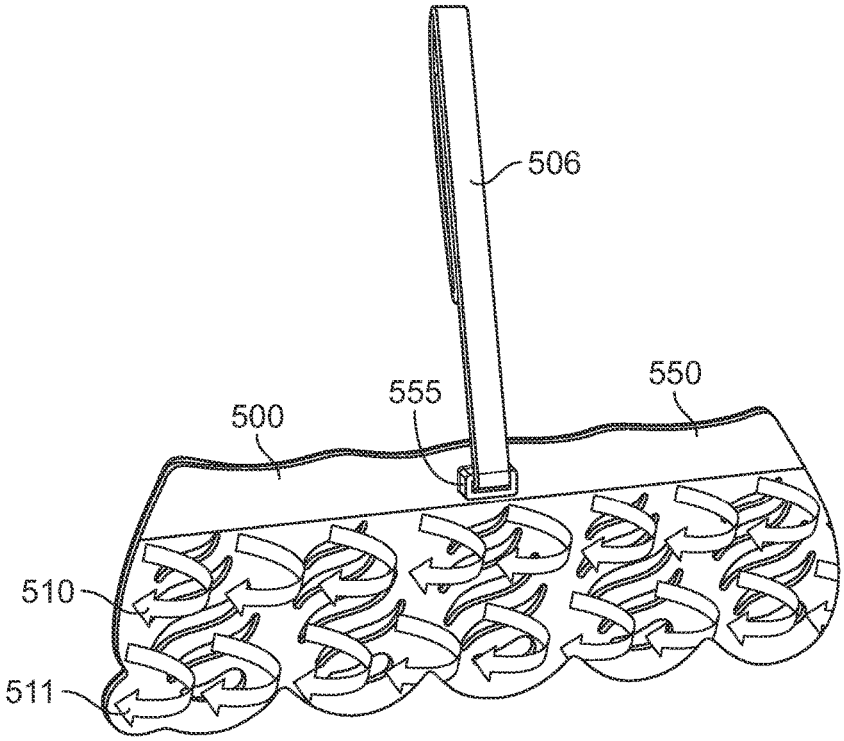
FIGS. 5A-5D depict another example dispenser.
Figure 5B:
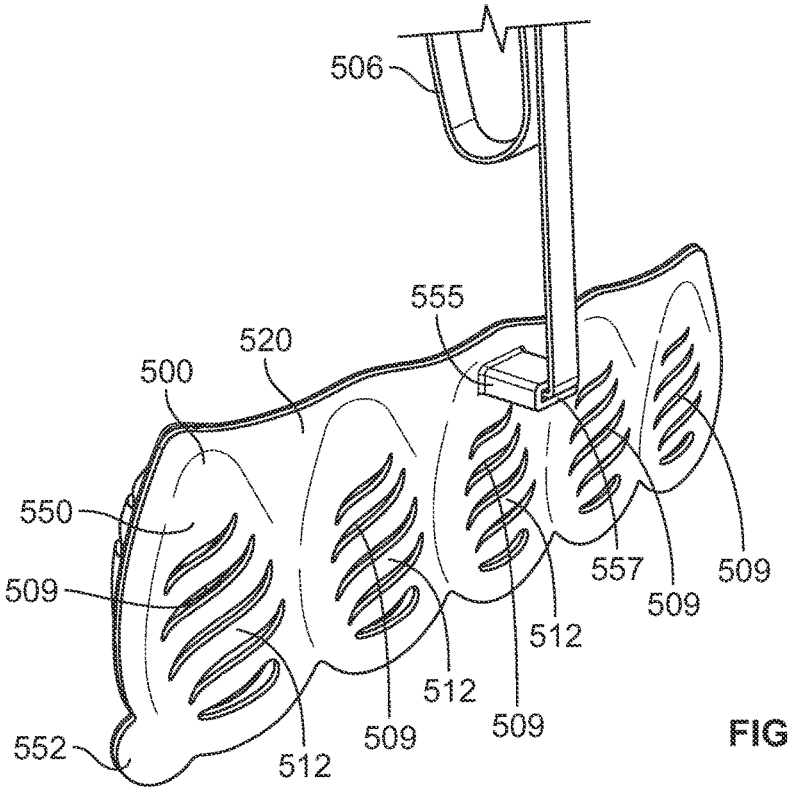
Figure 5C:
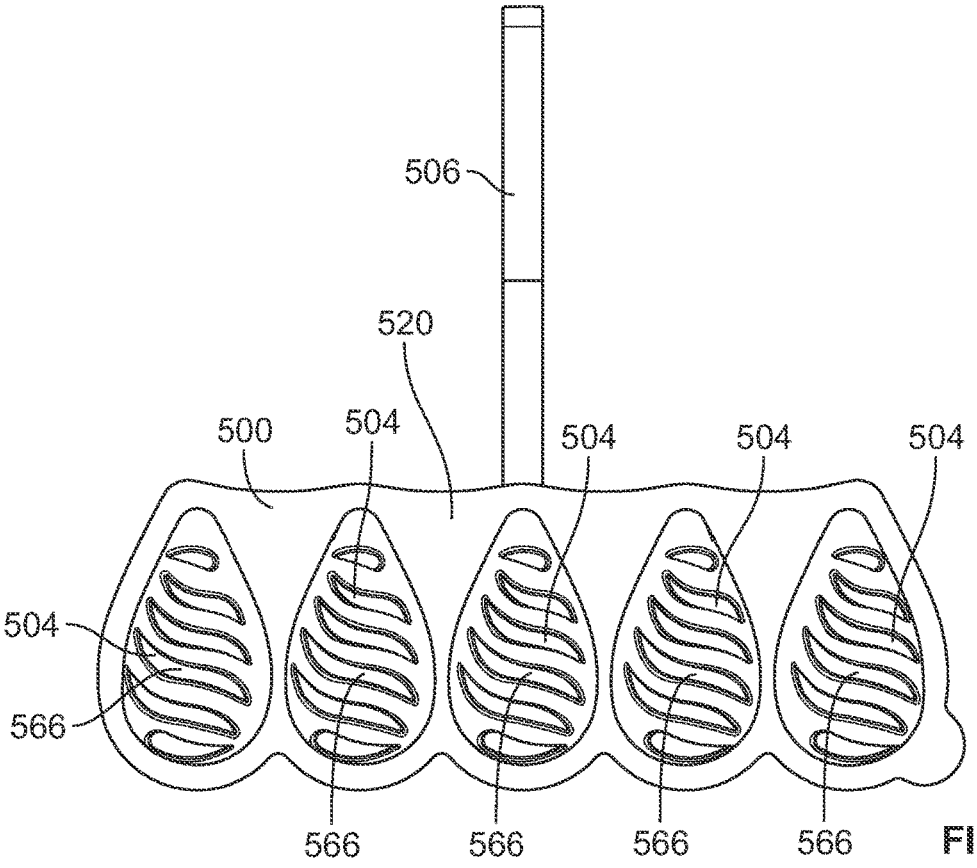
Figure 5D:
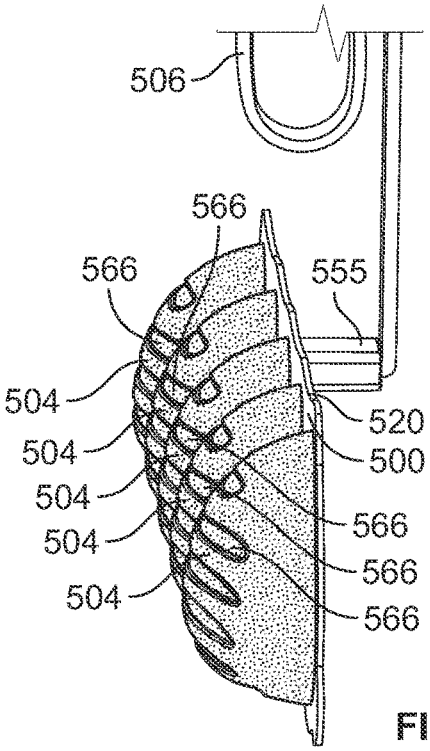

FIGS. 5A-5D depict another example dispenser 500, which includes similar features and functionality as the example dispenser described in relation to FIGS. 4A-4F, where similar reference numbers are used to identify similar components and features. FIG. 5A shows a front view of the example dispenser 500 with the cover 510 in place. FIG. 5B shows a front view of the example dispenser 500 with the cover 510 removed. FIG. 5C shows a rear view of the dispenser 500. FIG. 5D shows a left-side perspective view of the example dispenser 500.

The example dispenser 500 has similar features as the dispensers above; however, in this example, the tray 502 can be thermoformed, and the casing 550 can be injection molded. The material forming the tray 502 can be formed of any suitable plastic suitable for thermoforming in any desired color or can, like in the examples discussed herein, be formed of a transparent or translucent plastic material.

Furthermore, in one example, the example tray 502 can be formed of PET. The material forming the casing 550 can be formed of any suitable plastic, including any of the examples discussed herein, in any desired color or can like in the examples discussed herein be formed of a transparent plastic material. Also like in the above examples, it is contemplated that the tray 502 and the casing 550 can be formed with a predetermined radius of curvature in order to accommodate for the curvature of the toilet or formed flexible so as to flex or bend to accommodate for the curvature of the toilet bowl.

Unlike the example discussed above in relation to FIGS. 4A-4F, as shown by FIG. 5B, the hook 506 can be positioned so that the casing 550 faces toward the center of the toilet bowl when installed. In this example, the consumer can see the blocks of material 512 acting to clean and/or provide fragrance during use through the slots or openings 509 formed in the casing 550. However, it is also contemplated that the casing 550 can be configured to face in the opposite direction when installed as illustrated by the other examples discussed herein.

Like in the above examples described in relation to FIGS. 4A-4F, the hook or hanger 506 can be injection molded and may be attached to a front or a rear portion of the rim of a toilet bowl to hang the dispenser 500 in the toilet bowl. However, in this example, instead of providing a clip to retain the hanger 506 on the dispenser, a projection 555 for receiving the hanger 506 can be integrally molded into the casing 550 through the injection molding process. As shown in FIGS. 5B and 5D, the projection 555 extends from the wall 520 of the casing 550 and provides a mount for the hook 506. The projection 555 can be provided with a slot 557 for receiving an end of the hanger 506 to secure the hanger 506 in place on the dispenser 500. However, it is contemplated that the hanger be formed integral with the casing 550.

Similar to the above examples, before the dispenser 500 is placed into the toilet, the user removes the cover 510 from the dispenser 500 by pulling on the tab 511 adjacent the corresponding tab 552 on the casing 550. Once the cover is removed, the user can then hang the dispenser by the hook 506 in the toilet.

Figure 6A:
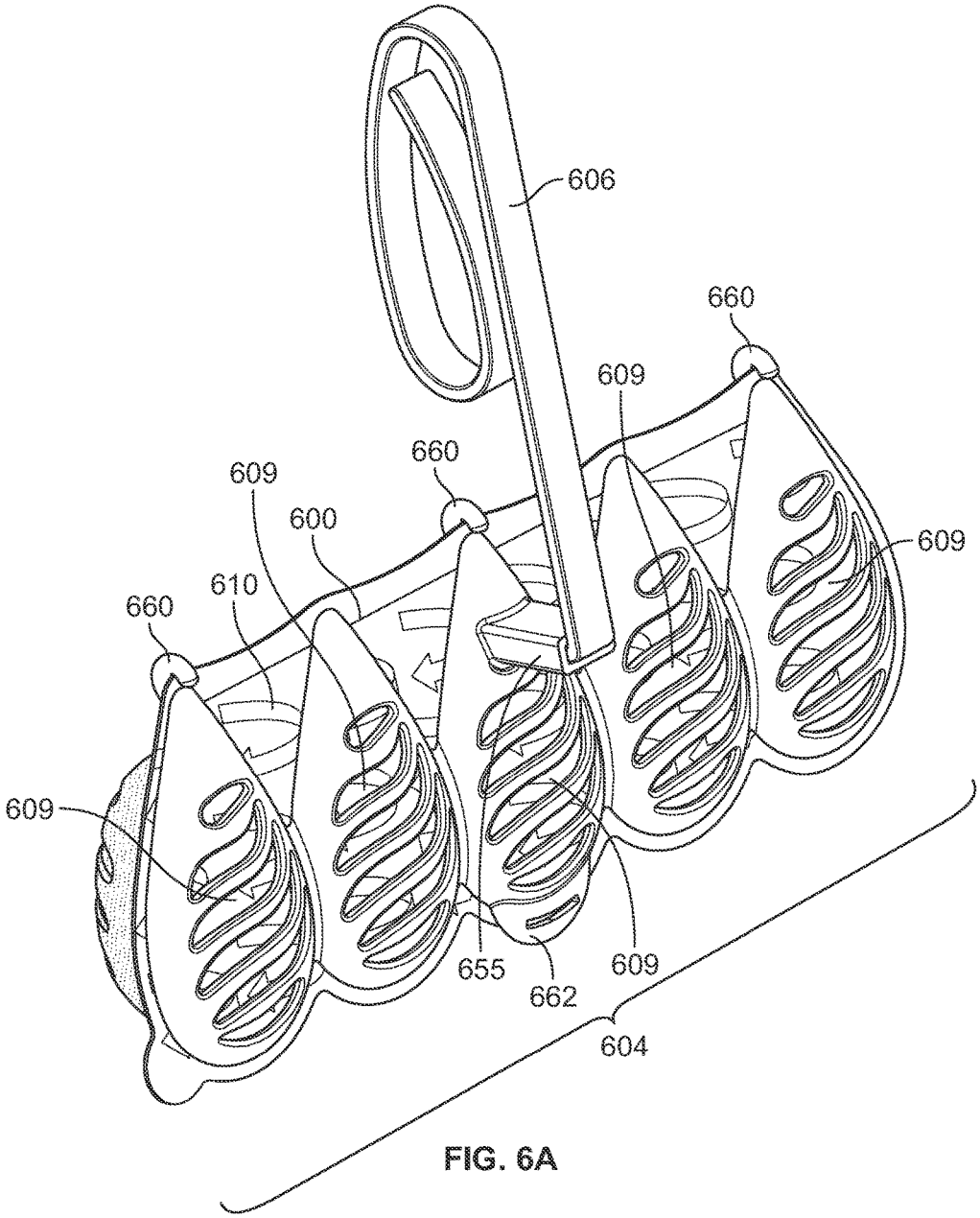
FIGS. 6A-6F depict another example dispenser.
Figure 6B:
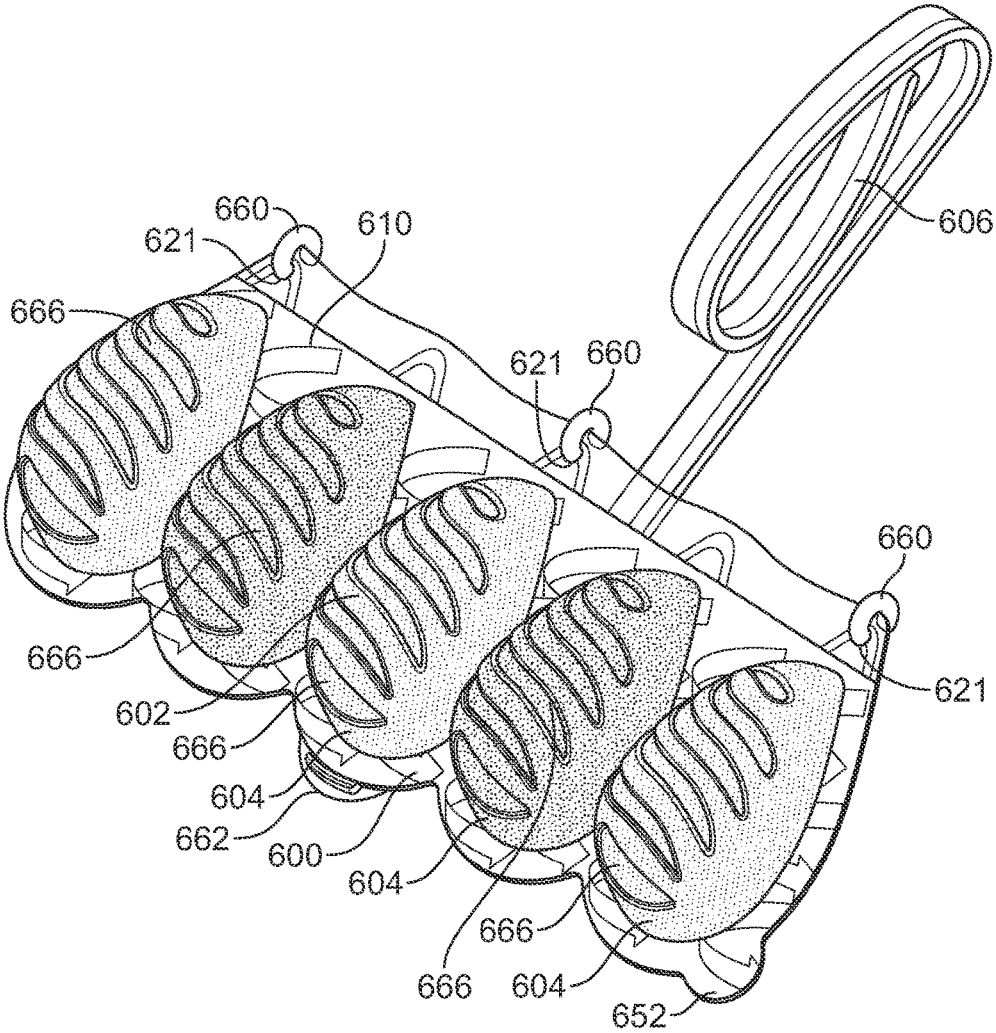
Figure 6C:
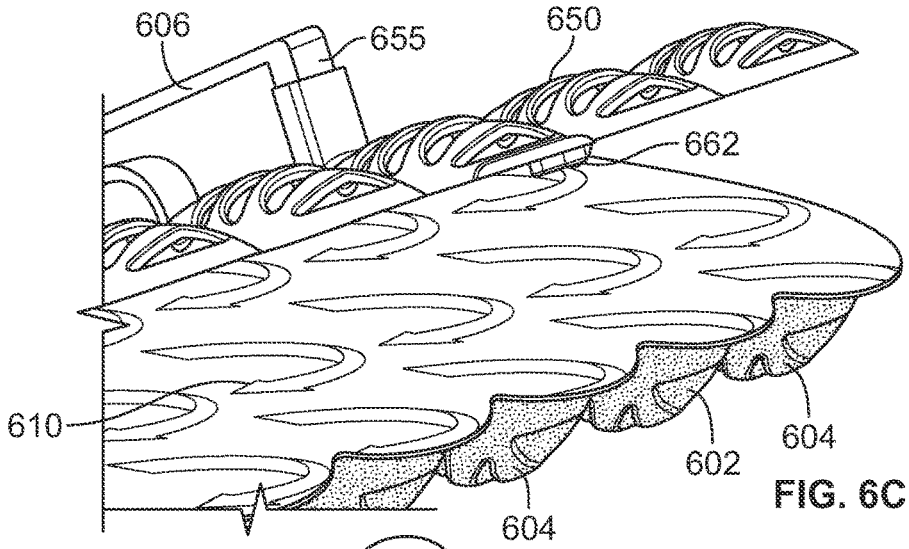
Figure 6D:
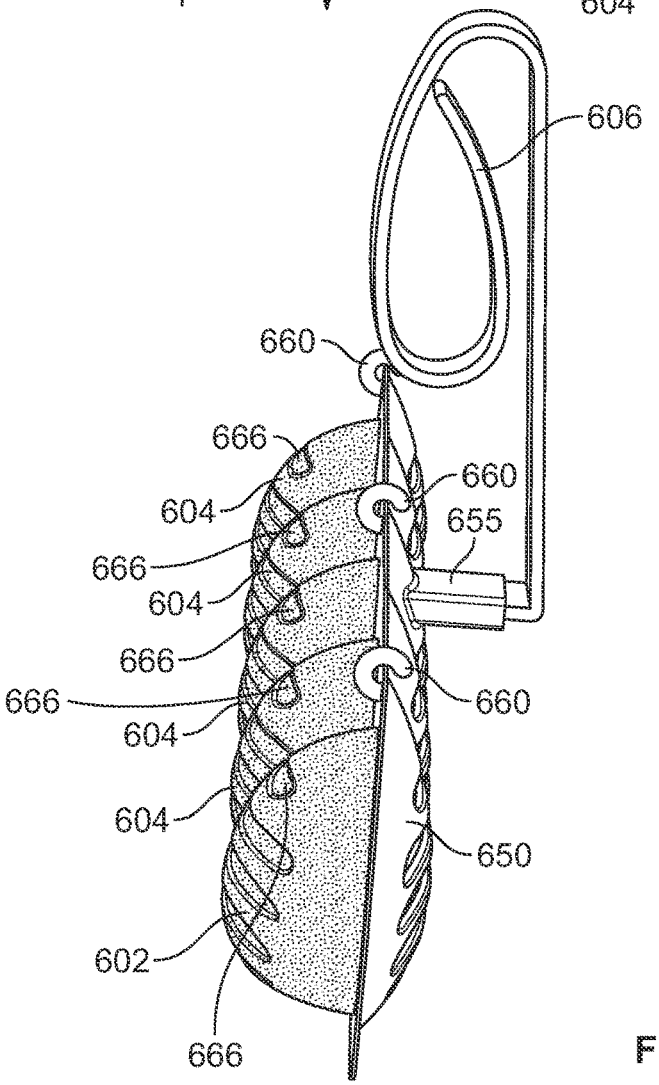
Figure 6E:
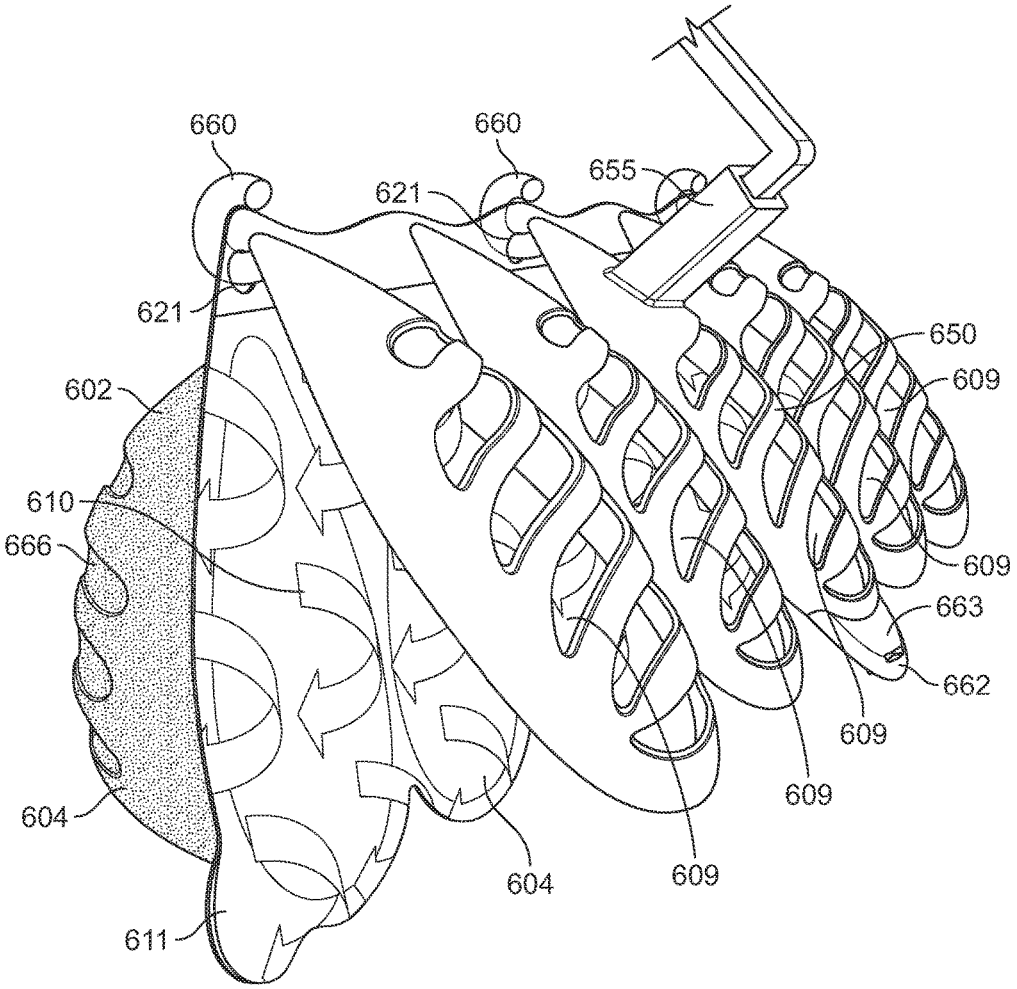
Figure 6F:
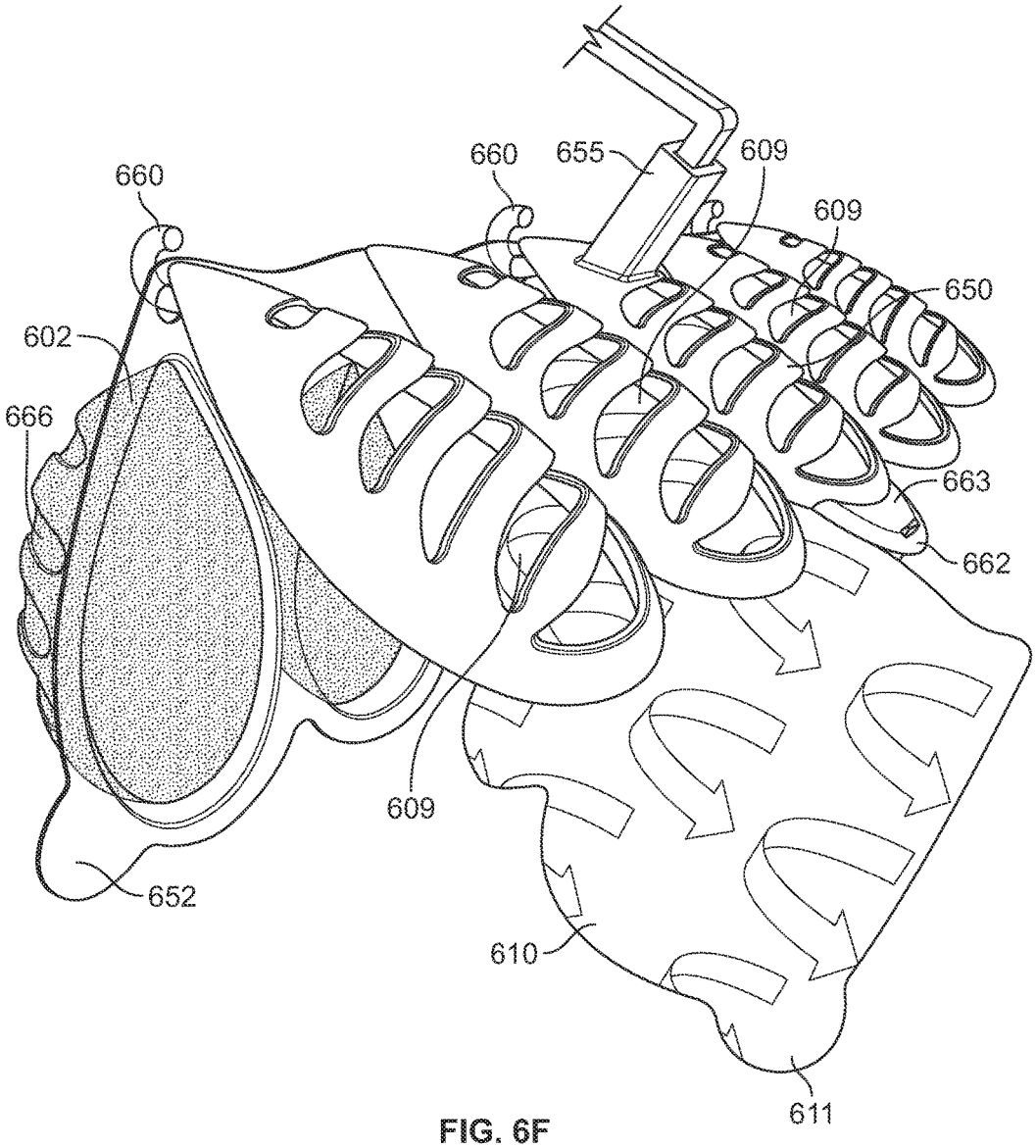

FIGS. 6A-6F depict another example dispenser 600, which is similar to the example dispenser described in relation to FIGS. 4A-4F including similar features and functionality, where similar reference numbers are used to identify similar components. FIG. 6A shows a front perspective view of the example dispenser 600 with the cover 610 in place. FIG. 6B shows a rear perspective view of the dispenser 600 with the cover 610 in place. FIG. 6C shows a bottom perspective view of the example dispenser 600 showing the casing 650 in an opened position. FIG. 6D shows a left-side view of the example dispenser 600 with the casing 650 in the closed position. FIG. 6E shows a left-side view of the example dispenser 600 with the casing 650 in an opened position. FIG. 6F shows a left-side view of the example dispenser 600 with the casing in an opened position, and the cover 610 partially removed.

Again, the example dispenser 600 can have similar features and functionality as the dispensers discussed above. However, in this example, the casing 650 can be connected to the tray 602 by several hinges 660 such that the casing 650 can be opened to remove the cover 610. Also, the cover 610 is provided in between the casing 650 and the tray 602 such that the user must open the casing 650 before removing the cover 610. Once the cover 610 is removed, the casing 650 can be closed to cover the tray 602 and the dispenser 600 can be placed into a toilet. Additionally, unlike the examples discussed above in relation to FIGS. 4A-5D, the casing 650 can be formed with exterior curvature such that it projects outwardly from the front of the dispenser 600 instead of extending flat like in the above examples.

As shown in FIGS. 6A and 6B, several hinges 660 are provided so that the user can open the casing 650 and peel off the cover 610 from the tray 602 before using the dispenser 600. As shown in FIG. 6B, in one example, the hinges 660 can be formed as rings or hook-like elements that extend into corresponding openings 621 on the tray 602 wall 620. However other hinge types are also contemplated, for example, living hinges, continuous hinges, and the like, to connect the casing 650 to the tray 602.

Also as shown in FIG. 6C, the casing 650 can be provided with a locking tab 662 positioned on the bottom center of the casing 650 which can be used to secure the casing 650 to the tray 602. Referring to FIGS. 6E and 6F, the locking tab 662 can include a portion 663 that extends downwardly from the casing 650 to provide the user with a grasping portion for easing the removal of the casing 650 from the tray 602. The casing 650 can be provided with several locking tabs along the length of the casing to secure the casing 650 in place on the tray 602. Additionally, although not shown, the locking tab 662 can include a tapered surface and/or the tray 602 can be provided with a corresponding opening or recess for the locking tab 662 which can help maintain the casing 650 in place on the tray 602. In other further examples, a locking tab could also be placed on the tray 602 for securing the casing 650 to the tray 602 or the tray 602 and casing 650 can be provided with alternative clasping systems or devices, which provide accessibility to the cover 610 and the individual compartments 604 for removal and use of the dispenser 600. In other alternative examples, the casing 650 could be formed of individual sections that each can include a hinge and a locking tab such that the individual sections can be opened separately.

Also like in the above example, the tray 602 can be thermoformed, and the casing 650 can be injection molded. The material forming the tray 602 can be formed of any suitable plastic suitable for thermoforming in any desired color or can, like in the examples discussed herein, be formed of a transparent or translucent plastic material. Furthermore, in one example, the example tray 602 can be formed of PET. The material forming the casing 650 can be formed of any suitable plastic, including any of the examples discussed herein, in any desired color or can like in the examples discussed herein be formed of a transparent plastic material. Also, like in the above examples, it is contemplated that the tray 602 and the casing 650 can be formed with a predetermined radius of curvature in order to accommodate for the curvature of the toilet or formed flexible so as to flex or bend to accommodate for the curvature of the toilet bowl.

Like in the above example described in relation to FIGS. 4A-4F, the hook or hanger 606 can be injection molded and may be attached to a front or a rear portion of the rim of a toilet bowl to hang the dispenser 600 in the toilet bowl. However, it is also contemplated that the hanger 606 be formed integral with the casing 650. An injection molded projection 655, which extends from the wall 620, can provide a mount for the hook 606. In particular, the projection 655 can be provided with a slot for receiving an end of the hanger 606 to secure the hanger 606 onto the dispenser 600.

As shown by FIGS. 6A and 6B, the hook 606 can be positioned so that the casing 650 faces toward the center of the toilet bowl when installed. In this example, the consumer can see the blocks of material 612 acting to clean and/or provide fragrance during use through the slots or openings 609 formed in the casing 650. However, it is also contemplated that the casing 650 can be configured to face in the opposite direction when installed as illustrated by the other examples discussed herein.

Additionally, similar to the example shown above, the individual compartments 604 are configured to receive individual sections of material 612, which can be in the form of a gel, paste, and/or solid. The casing 650 can be provided with a degree of curvature to form a head space between the tray 602 and the casing 605. This allows for additional water to come into contact with the individual sections of material 612, which can increase the rate that the sections of material 612 dissolve in the toilet water.

Like in the above examples, the tray 602 and the casing 650 can also be provided with ornamental patterns or shapes to enhance the appearance of the dispenser 600 to entice the consumer into purchasing the dispenser 600. Like in the above examples, the front of the tray 602 can be provided with a series of embossments 666, which may correspond to or can be similar to the openings 609 formed in the casing 650. Alternatively, like in certain examples discussed herein, both sides of the dispenser 600 could be provided with openings to allow for a quicker rate of release of the material 612 within the toilet bowl.

To use the dispenser 600, the user can remove the casing 650 by rotating the casing 650 away from the tray 602 to release the locking tab 662 and opening the dispenser 600 to expose the cover 610. As shown in FIGS. 6E and 6F, once the casing 650 is rotated away from the tray 602, the user can remove the cover 610 by pulling on the tab 611 adjacent the corresponding tab 652 on the casing 650 to peel the cover 610 away from the tray 602. After the cover 610 is removed from the tray 602, the user can then secure the tray 602 and the casing 650 by pushing the tray 602 and the casing 650 together thereby engaging the locking tab 662. The user can then place the dispenser 600 in the toilet for use. It is also contemplated that the user can refill the compartments 604 with formulation by removing the casing 650 from the tray 602. For example, refill formulation can be supplied with or supplied separately from the dispenser 600. In this way, the user could reuse the dispenser 600 repeatedly.

Figure 7:
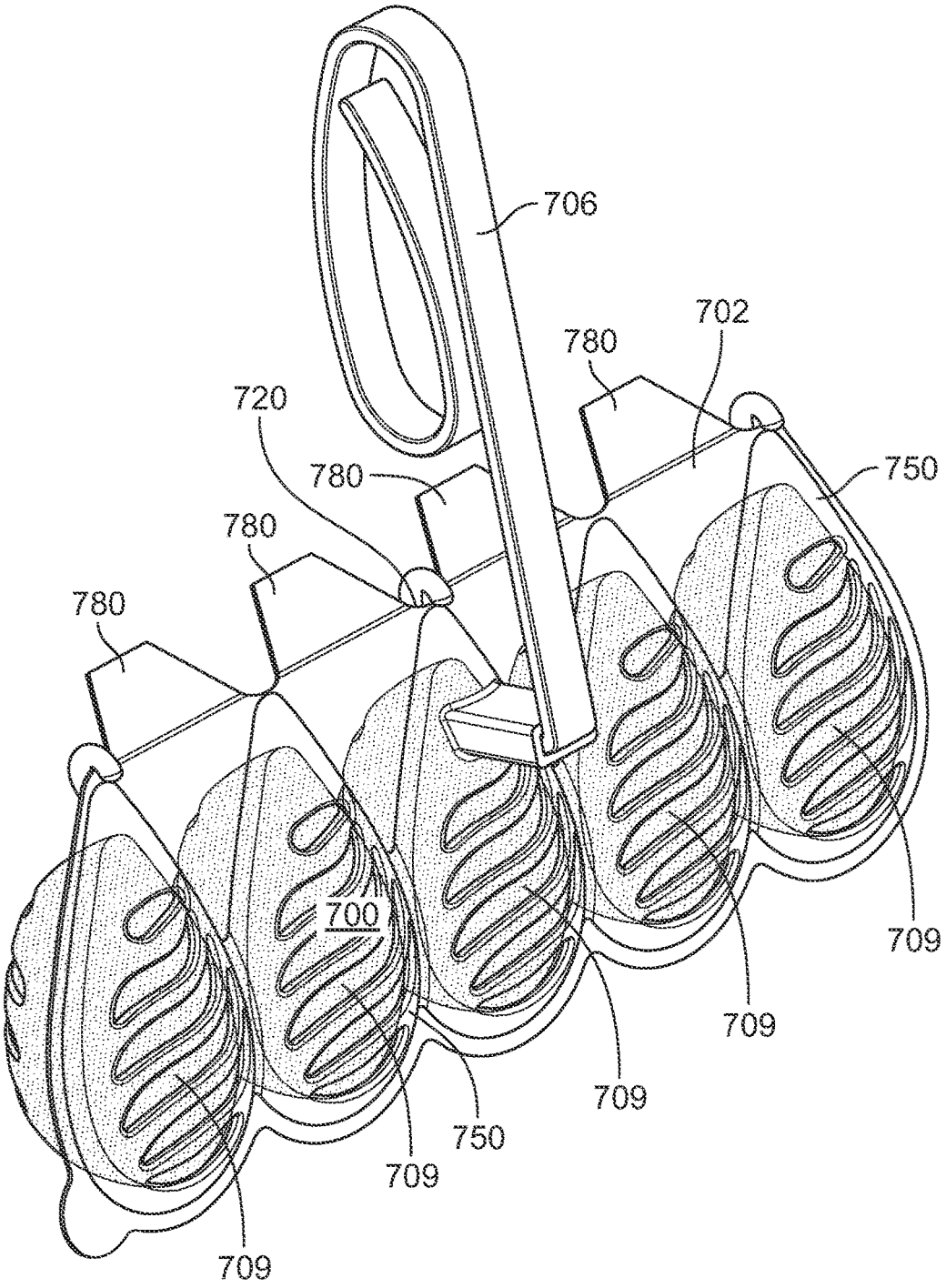
FIG. 7 depicts another example dispenser.

FIG. 7 shows an alternative example dispenser 700, which is similar to the example dispensers described above which can include similar features and functionality, where similar reference numbers are used to identify similar components. In this example, however, the tray 702 wall 720 can be provided with a series of water deflectors 780 which help the dispenser 700 to operate in both open-rim and box-rim style toilets. Box-rim style toilets typically have a closed water rim with holes around the underside of the rim that direct water into the bowl of the toilet. The water deflectors 780 can help to deflect water over the front or rear of the dispenser depending on their orientation to ensure that the water goes into the slots 709 of the casing 750. The water deflectors 780 can be provided with a predetermined angle such that the water is properly guided over the dispenser and into the slots 709. In one example, the water deflectors 780 can be orientated at 30 degree to 60 degree angles in relation to the wall 720. In one specific example, the water deflectors 780 can be orientated at a 45 degree angle in relation to the wall 720. The water deflectors 780 can also be formed tapered from the top to the bottom, which helps to collect the desired amount of water for the slots 709. In other examples, the water deflectors 780 can be formed in a triangular shape. However, other suitable shapes are contemplated depending on the amount of water that is desired to be directed into the slots 709.

Figure 8:
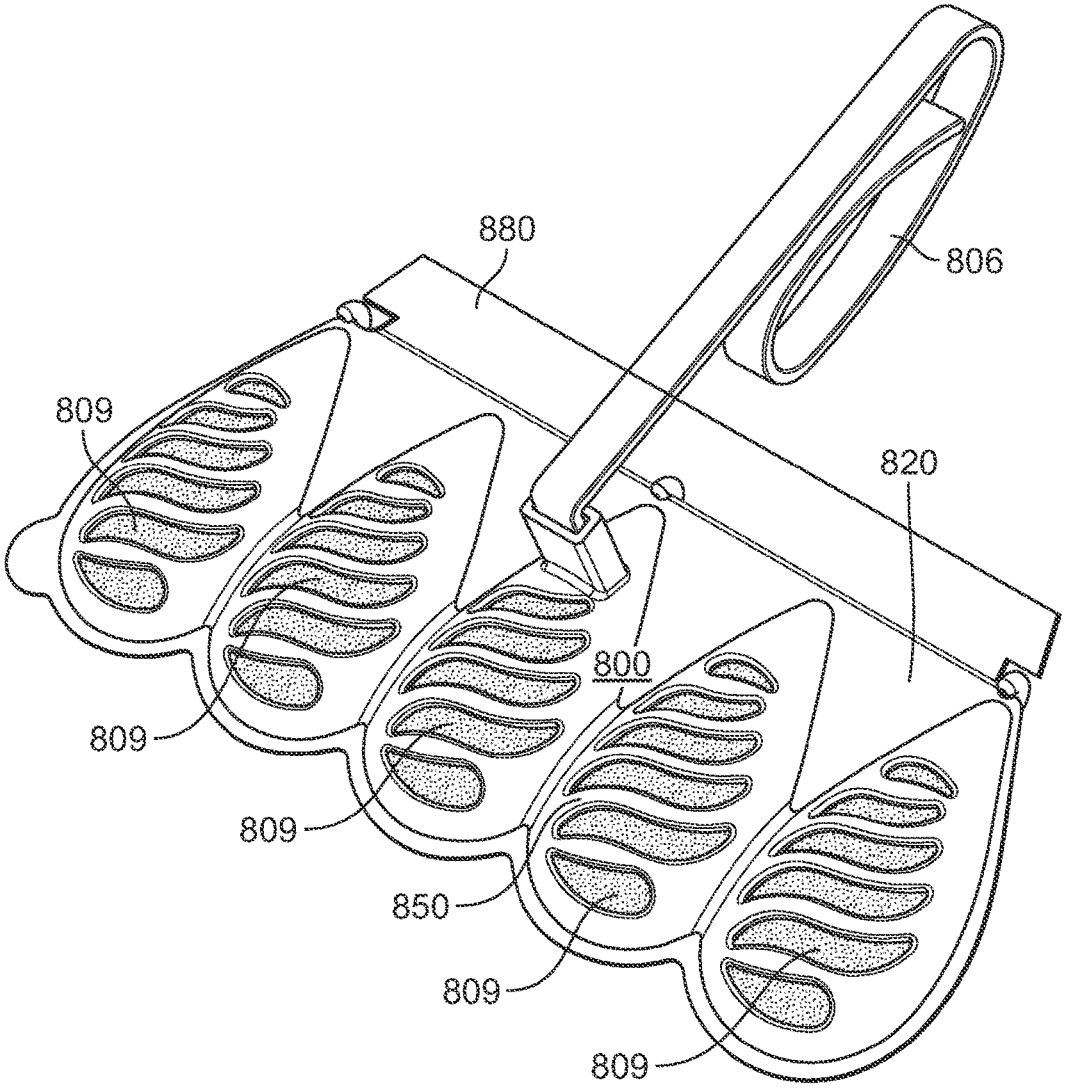
FIG. 8 depicts another example dispenser.

FIG. 8 shows another example dispenser 800, which is similar to the example dispensers described above which can include similar features and functionality, where similar reference numbers are used to identify similar components. This example is similar to the example discussed above in relation to FIG. 7. However, in this example, a single water deflector 880 can be provided to help to deflect water over the front or rear of the dispenser 800 depending on its orientation to ensure that the water goes into the slots 809 of the casing 850. Like in the above example, the water deflector 880 can be provided with a predetermined angle such that the water is properly guided over the dispenser and into the slots 709. In one example, the water deflector 880 can be orientated at 30 degree to 60 degree angles in relation to the wall 820, and in one specific example the water deflector 880 can be orientated at a 45 degree angle in relation to the wall 720. In addition to the specific dispensers shown in FIGS. 7 and 8, it is contemplated that the water deflectors of FIGS. 7 and 8 can be used in conjunction with any of the example dispensers discussed herein to accommodate for both open-rim and box-rim style toilets.

In relation to the examples discussed herein, each section or block of the material can provide a different function (e.g., cleaning, fragrancing, etc.) and can be different colors. Forming the rimblock of different materials could convey different benefits to consumer. For example, consumers want to keep toilet clean and always presentable for family to use. By forming the sections of the material of different materials, the rimblock can effectively remove stains, remove odors and provide a nice fragrance to the user. Also one of the sections could be configured to foam, which is a visual cue to the user to reassure product is working.

The dispenser components of the examples discussed herein can be made of single-layer sheets or multi-layer laminate sheets. The materials can be transparent, translucent, or opaque as deemed desirable for various product supply, packaging, marketing, and various other business considerations. A non-limiting example of material includes heat sealable thermoplastic materials such as polyethylene, polypropylene, or RPET. Layered laminates having generally a sandwich construction can include any combination or order of polyethylene, cellophane, paper, polyester, and so forth including variations thereof. Selection of materials, and the thickness thereof, is determined by the nature of the material being packaged. The selection of biodegradable materials generally includes consideration of decomposition in both natural aerobic and anaerobic environments. Specifically for plastics material, biodegradability is achieved by materials that can be metabolized by microorganisms into inert material having minimal impact on the environment. In addition, biodegradable or other environmentally compatible materials can include water-soluble material. Without being limited by any particular theory, water-soluble materials are materials that disintegrate or dissolve in the presences of water. Non-limiting examples of water-soluble material include, but is not necessarily limited to water-soluble polymers, particularly polymers that are useful in film forming, such as poly-vinyl alcohol, cellulose ether, and so forth either individually or in various combinations. As generally known in the art, various additives can be incorporated into the water-soluble polymers to alter disintegration and dissolution as desired.

In one example, a dispenser system may include a tray comprising at least one compartment containing a formulation. The formulation can include one of a cleaner or fragrance. A hanger can be configured to suspend the tray from a toilet bowl rim such that when the toilet is flushed, the water from the toilet comes into contact with the formulation to release the one of a cleaner or fragrance. A cover can be configured to seal the at least one compartment from moisture and fragrance. In one example, the tray can include a plurality of compartments with a plurality of formulations contained therein, and at least one of the plurality formulations can be different from another one of the plurality of formulations. At least one of the plurality of formulations can have a different color than another one of the plurality of formulations. In one example, the compartments can be oval shaped. The cover can be incorporated into a packaging such that when the tray is removed from the packaging, the at least one compartment is exposed. The tray and the at least one compartment can be transparent and can form part of the packaging. In addition, the compartment can be in the form of a cup, and formulation can be placed into the cup.

In one example, a dispenser system can include at least one formulation comprising one of a cleaner or a fragrance, a porous material covering the formulation, a hanger configured to suspend the dispenser from a toilet bowl rim. In one example, the porous material can be a mesh material having a series of holes, apertures or a combination thereof, which can expose the formulation to water from the toilet during flushing to release the at least one of the cleaner or fragrance. A cover can be configured to wrap the mesh material and the formulation, and can be configured to seal the mesh material and the formulation from moisture and fragrance. The formulation can be in the form of a prism or cylinder. In one example, the dispenser system can include a plurality of formulations, and at least one of the plurality of formulations can be different from another one of the plurality of formulations. At least one of the plurality of formulations can have a different color than another one of the plurality of formulations. The formulations can be arranged in a plurality of layers, and the plurality of formulations can be formed in an extrusion operation.

In one example, a dispenser system can include at least one formulation comprising one of a cleaner or a fragrance, a porous material providing a backing for the formulation, and a hanger configured to suspend the porous material from a toilet bowl rim. Additionally, the porous material can be a mesh material having a series of openings, holes, apertures, or combinations thereof, which can expose the formulation to water from the toilet during flushing to release the at least one of the cleaner or fragrance. A cover can be configured to cover the mesh material and the formulation, and the cover seals the mesh material and the formulation from moisture and fragrance prior to use. The formulation can be in a rectangular shape. In one example, the dispenser can include a plurality of formulations, and at least one of the plurality of formulations can be different from another one of the plurality of formulations. At least one of the plurality of formulations can have a different color than another one of the plurality of formulations.

In another example, a dispenser system may include a tray having at least one teardrop-shaped compartment having a formulation. The compartment may include an aperture for receiving fluid, and the formulation may include one of a cleaner or fragrance. A hanger can be provided for suspending the tray from a toilet bowl rim. A casing may also be provided that may be configured to cover at least a portion of the at least one compartment and at least a portion of the formulation to allow for fluid to interact with the formulation and dissolve the formation into the fluid. In one example, the tray and the cover can be thermoformed. In another example, the tray can be thermoformed and the casing can be injection molded. Alternatively, the tray and the cover can both be injection molded.

In another example, the dispenser system can include a plurality of compartments with a plurality of formulations stored therein, and at least one of the plurality formulations can be different from another one of the plurality of formulations. At least one of the plurality of formulations may have a different color than another one of the plurality of formulations. The tray may also include a wall, and the wall may include a series of undulations. At least a portion of the wall can extend above the plurality of compartments. Also the wall and the plurality of compartments can form a series of gaps. The casing may further include at least one slit or opening to allow for fluid to flow into the at least one compartment to dissolve the formulation into the fluid. The casing may include a plurality of slits in other examples.

In another example, a dispenser system may include a tray having at least one compartment having a formulation. The compartment can include an aperture for receiving a fluid, and the formulation can be one of a cleaner or fragrance. A hanger can be configured to suspend the tray from a toilet bowl rim, and a casing can be configured to cover at least a portion of the at least one compartment and at least a portion of the formulation to allow for fluid to flow to interact with the formulation. In one example both the tray and the cover are thermoformed. In an alternative example, the tray can be thermoformed and the casing can be injection molded.

In another example, the dispenser system can include a plurality of compartments with a plurality of formulations stored therein, and each one of the plurality of compartments can have an opening. Each one of the plurality of compartments can have a plurality of elongated openings. In one example, at least one of the plurality formulations is different from another one of the plurality of formulations. Also at least one of the plurality of formulations can have a different color than another one of the plurality of formulations. The compartments can be teardrop shaped. At least a portion of the wall can extend above the plurality of compartments.

The casing can cover the openings of each one of the plurality of compartments. The casing can further include at least one slit or opening to allow for fluid to flow into the at least one compartment to dissolve the formulation into the fluid or the casing can include a plurality of slits to allow for fluid to flow into the at least one compartment to dissolve the formulation. The dispenser can also include one or more water deflectors for deflecting or directing water over either the front or the rear of the dispenser to ensure that water is directed into the slits.

In one example, the casing can be configured to be removable from the tray. In particular, the casing can include a hinge connecting the casing to the tray, and the hinge can be configured to open to remove the casing from the tray. The hinge may include at least one hook. A cover can be placed between the tray and the casing such that when the casing is removed from the tray the cover can be removed. The casing may also include a locking tab for securing the casing to the tray and a grasping portion for easing the removal of the casing from the tray. In another example, the casing can be provided with a degree of curvature to form a head space between the tray and the casing. In another example, the casing can be formed flat, and the casing can include a series of slots configured to receive fluid to interact with the formulation.

In another example, the hanger can be mounted to a clip and the clip is received on the at least one compartment of the tray. The clip may include a projection for receiving the hanger. The clip can be configured to be removable from the tray. The hanger can also be configured to connect to either the tray or casing to orient the dispenser in a toilet to face either inwardly or outwardly.

An example dispenser system may include a tray having at least one compartment housing a formulation which may include one of a cleaner or a fragrance, and the compartment can include a first side closed to fluid and a second side open to fluid. The second side can define an aperture for receiving the formulation. The example dispenser can include a hanger configured to suspend the tray from a toilet bowl rim, and a casing configured to mount to the tray and to cover the aperture. The casing can include at least one opening to allow for fluid to interact with the formulation to dissolve the formulation into the fluid. Additionally a cover can seal the aperture of the compartment.

The hanger can be integrally molded to a clip, and the clip can be removable from the tray. The clip can include a retaining ring, and the at least one compartment of the tray can be configured to extend through the ring formed in the clip. The clip can also include a tab and at least one projection for securing the clip to the tray. The compartment can be formed teardrop shaped. The formulation in the compartment can be spaced from the casing to define a head space. The formulation can fill 50% to 95% of the compartment to form the head space.

In one example, the tray can include a plurality of compartments with a plurality of formulations stored therein, and each one of the plurality of compartments can have a first side and a second side, the first side can be closed to fluid and the second side can define an aperture for receiving fluid. At least one of the plurality formulations can be different from another one of the plurality of formulations. At least one of the plurality of formulations can have a different color than another one of the plurality of formulations. The casing can cover the apertures of each one of the plurality of compartments, and the casing can define a plurality of openings to allow for fluid to interact with the plurality of formulations. The plurality of openings of the casing define an open area exposing the apertures and the open area over the apertures can range from 40% to 60% of the total area of the apertures.

In one example, the casing can be removable from the tray. A hinge can connect the casing to the tray and the hinge can be configured to open to remove the casing from the tray. The cover can be placed between the tray and the casing such that when the casing is removed from the tray the cover can be removed.

An example method of forming a dispenser system may include forming a tray with at least one compartment, forming the compartment with a first side closed to fluid and a second side open to fluid, providing the second side with an aperture and providing the compartment with a formulation comprising one of a cleaner or a fragrance, providing a hanger configured to suspend the tray from a toilet bowl rim, mounting a casing to the tray to cover the aperture, and providing the casing with at least one opening to allow for fluid to interact with the formulation to dissolve the formulation into the fluid, sealing the aperture of the compartment with a cover. The casing can be formed flat and the casing may include a plurality of openings configured to receive and direct fluid into the aperture to interact with the formulation. The method may also include integrally molding the hanger to a clip and configuring the clip to be removable from the tray.

The method may also include providing the tray with a plurality of compartments and filling the plurality of compartments with a plurality of formulations stored, each one of the plurality of compartments having a first side and a second side, the first side being closed to fluid and the second side defining an aperture for receiving fluid, forming at least one of the plurality formulations different from another one of the plurality of formulations, covering the apertures of each one of the plurality of compartments with the casing, and providing the casing with a plurality of openings to allow for fluid to interact with the plurality of formulations. The plurality of openings of the casing can define an open area over the apertures and the open area can range from 40% to 60% of the total area of the apertures. The formulation in the compartment can be spaced from the casing, and the method can include filling 50% to 95% of the compartment with the formulation.

This disclosure is not limited to the disclosed embodiments. To the contrary, the present disclosure is intended to cover various modifications and equivalent arrangements.

What is claimed is:

1. A dispenser system for treating a toilet, the dispenser system comprising:

a tray having a rim at least partially surrounding a plurality of compartments, each compartment housing a composition comprising a gel, paste, or solid, each compartment having a first side configured to be closed to flushing water and a second side configured to be open to flushing water, the second side defining an aperture for receiving the composition; and a hanger configured to suspend the tray from a toilet bowl rim; and a cover coupled to the rim for sealing the aperture of each compartment and configured to be removed by a user prior to use.

2. The dispenser system of claim 1 wherein the composition of at least one of the plurality of compartments comprises a transparent or translucent gel material.

3. The dispenser of system of claim 2 wherein the compartment housing the transparent or translucent gel material is also transparent or translucent so that the transparent or translucent gel is viewable through the compartment.

4. The dispenser of system of claim 3 wherein the cover provides a reflective surface behind the transparent or translucent gel.

5. The dispenser system of claim 1 further comprising a casing secured to the tray and at least partially covering an opening of at least one of the compartments, the casing defining an opening over the opening of the compartment that allows flushing water to interact with the composition.

6. The dispenser system of claim 5 wherein the casing at least partially covers the openings of all of the compartments.

7. The dispenser system of claim 5 wherein the size of the opening in the casing is approximately 40 percent to 60 percent of the size of the opening of the compartment.

8. The dispenser system of claim 5 wherein the casing is movable relative to the tray.

9. The dispenser system of claim 8 further comprising a hinge connecting the casing to the tray and wherein the hinge is configured to open to move the casing relative to the tray.

10. The dispenser system of claim 9 wherein the cover is placed between the tray and the casing such that when the casing is moved relative to the tray the cover can be removed by the user prior to use.

11. The dispenser system of claim 1 wherein the hanger is integrally molded to a retaining ring and at least one compartment of the tray extends through the retaining ring.

12. The dispenser system of claim 11 wherein the tray comprises an odd number of compartments and the compartment in a central position extends through the retaining ring.

13. The dispenser system of claim 1 wherein the composition of at least one of the plurality of compartments is different from the composition of another one of the plurality of compartments.

14. The dispenser system of claim 13 wherein at least one of the plurality of compartments has a different color than another one of the plurality of compartments.

15. The dispenser system of claim 1 wherein each compartment is teardrop shaped.

16. The dispenser system of claim 1 wherein the composition in each compartment is spaced inward from the rim of the tray to define a head space.

17. The dispenser system of claim 16 wherein the composition fills 50% to 95% of each compartment to form the head space.

18. A method of forming a dispenser system comprising:

forming a tray with a plurality of compartments, forming each compartment with a first side closed to fluid and a second side open to fluid, providing the second side with an aperture and providing each compartment with a composition comprising a gel, paste, or solid;

providing a hanger configured to suspend the tray from a toilet bowl rim;

mounting a casing to the tray to cover the aperture of each compartment, and providing the casing with at least one opening to allow for fluid to interact with the composition to dissolve the composition into the fluid; and sealing the aperture of each compartment with a cover configured to be removed by a user prior to use.

19. The method of claim 18 further comprising forming the casing flat and providing the casing with a plurality of openings configured to receive and direct fluid into each aperture to interact with the composition.

20. The method of claim 19 further comprising covering the apertures of each one of the plurality of compartments with the casing and providing the casing with a plurality of openings to allow for fluid to interact with the composition in each of the plurality of compartments.

21. The method of claim 20 further comprising filling from 50% to 95% of each compartment with the composition.

22. The method of claim 18 further comprising integrally molding the hanger to a clip and configuring the clip to be removable from the tray.

23. The method of claim 18 wherein the composition of at least one of the plurality of compartments is different from the composition of another one of the plurality of compartments.

24. The method of claim 18 wherein the at least one opening of the casing define an open area over the apertures and wherein the open area ranges from 40% to 60% over the total area of the apertures.

25. The method of claim 18 wherein the composition in at least one of the plurality of compartments is spaced from the casing to define a head space.

* * * * *